US006378498B2

(12) United States Patent
Kohketsu et al.

(10) Patent No.: US 6,378,498 B2
(45) Date of Patent: Apr. 30, 2002

(54) ACCUMULATOR TYPE FUEL INJECTION SYSTEM

(75) Inventors: Susumu Kohketsu, Tokyo; Keiki Tanabe, Yokohama, both of (JP)

(73) Assignee: Mitsubishi Jidosha Kogyo Kabushiki Kaisha (JP)

( * ) Notice: Subject to any disclaimer, the term of this patent is extended or adjusted under 35 U.S.C. 154(b) by 0 days.

(21) Appl. No.: 09/758,944

(22) Filed: Jan. 11, 2001

Related U.S. Application Data

(63) Continuation of application No. 09/443,728, filed on Nov. 19, 1999, now abandoned.

(30) Foreign Application Priority Data

Nov. 20, 1998 (JP) ..... 10-331359
Nov. 26, 1998 (JP) ..... 10-335734
Nov. 26, 1998 (JP) ..... 10-335735
Nov. 26, 1998 (JP) ..... 10-335736

(51) Int. Cl.[7] ..... F02M 37/04
(52) U.S. Cl. ..... 123/447; 123/198 D
(58) Field of Search ..... 123/446, 447, 123/456, 198 D, 514, 506

(56) References Cited

U.S. PATENT DOCUMENTS 5,197,438 A * 3/1993 Kumano et al. ..... 123/506
5,295,469 A * 3/1994 Kariya et al. ..... 123/456
5,839,413 A * 11/1998 Krause et al. ..... 123/447
5,983,863 A * 11/1999 Cavanagh et al. ..... 123/447
6,076,504 A * 6/2000 Stavnheim et al. ..... 123/447
6,112,721 A * 9/2000 Kouketsu et al. ..... 123/447

* cited by examiner

*Primary Examiner*—Carl S. Miller
(74) *Attorney, Agent, or Firm*—Rossi & Associates

(57) ABSTRACT

An accumulator type fuel injection system adapted to prevent engine trouble by making a judgement that fuel injection rate switching change-over valves provided correspondingly to fuel injection nozzles in cylinders, a valve for controlling the pressure in a low-pressure accumulator or means for detecting fuel pressures in accumulators gets out of order, and carrying out when any of these parts break down a control operation of a limp-home mode in which a region of an operation of an engine is limited. To provide such an accumulator type fuel injection system, a control means 8 is formed so that, when a judgement that first control valves 5, a second control valve 34 or pressure sensors 3*a*, 4*a* for detecting the fuel pressures in the respective accumulators get out of order is given, the control means 8 sets a discharge pressure of a fuel pump 1 not higher than a permissible pressure in a second accumulator 4, and injects a fuel from fuel injection nozzles 9.

18 Claims, 13 Drawing Sheets

ACCUMULATOR TYPE FUEL INJECTION SYSTEM

CROSS-REFERENCE TO RELATED APPLICATIONS

The present application is a continuation application of U.S. Application Ser. No. 09/443,728 filed Nov. 19, 1999 now abandoned and claims priority therefrom.

FIELD OF THE INVENTION

This invention relates to an accumulator type fuel injection system.

BACKGROUND OF THE INVENTION

There is an accumulator type fuel injection system (common rail system) as a fuel injection system for a diesel engine, capable of improving the engine performance in a wide operational region from a low-speed region to a high-speed region by stably supplying a high-pressure fuel accumulated in an accumulator to each cylinder of the engine. When a fuel injection rate immediately after the starting of a fuel injection operation is excessively high even in a case where such a fuel injection system is used, sudden explosion combustion is carried out in an initial stage of the combustion of the fuel, so that not only the engine noise but also the nitrogen oxide (NOx) content of an exhaust gas increases.

To eliminate such inconveniences, an accumulator type fuel injection system has been proposed which is adapted to inject a fuel at a lower fuel injection rate in an initial stage of each fuel injection cycle. The fuel injection system relating to this proposition is provided with, for example, a low-pressure accumulator adapted to store therein a low-pressure fuel, a high-pressure accumulator adapted to accumulate therein a high-pressure fuel, a change-over valve adapted to switch a fuel injection rate from one to another by communicating the low-pressure accumulator or the high-pressure accumulator selectively with an injector (fuel injection nozzle), and a switch valve adapted to control the fuel injection time by communicating and shutting off a pressure control chamber of the injector and a fuel tank with and from each other.

Regarding the formation of a fuel pressure in the accumulators, there is, for example, a fuel injection system adapted to obtain low-pressure and high-pressure fuels by using low-pressure and high-pressure fuel pumps which are driven by an engine respectively, or a fuel injection system adapted to obtain a high-pressure fuel by a high-pressure fuel pump, and a low-pressure fuel by regulating the pressure of the high-pressure fuel introduced into a low-pressure accumulator (for example, Japanese Patent Laid-Open 93936/1994).

In an accumulator type fuel injection system (for example, WO98/09068) adapted to obtain a low-pressure fuel in a low-pressure accumulator from a high-pressure fuel in a high-pressure accumulator, a fuel chamber (fuel reservoir) of an injector is filled with a low-pressure fuel with the injector kept closed by closing a fuel injection time control switch valve provided correspondingly to the injector in each cylinder, and switching a fuel injection rate change-over valve to a low-pressure side, and the injector is kept closed. When the fuel injection starting time comes, a switch valve is opened to open the injector and thereby carry out initial low-pressure injection (which will hereinafter be referred to as "low-pressure injection") of a fuel from a nozzle. When a low-pressure injection period elapses, the change-over valve is switched to a high-pressure side, and main high-pressure injection (which will hereinafter be referred to as "high-pressure injection") is carried out by injecting the high-pressure fuel, which is supplied from the high-pressure accumulator, from the nozzle. When the injection finishing time comes, the change-over valve is switched to the low-pressure side with the switch valve closed at the same time. Namely, the controlling of an injection waveform of the fuel is done by switching the low-pressure and high-pressure accumulators from one to the other by the change-over valve during a fuel injection operation.

In the low-pressure accumulator, a low-pressure fuel is obtained by regulating the pressure of the high-pressure fuel collected between the change-over valve and the fuel chamber of the injector after the change-over valve is closed. Namely, the fuel in the low-pressure accumulator is discharged to a fuel tank (atmosphere-opened side) by controlling a duty of a pressure control valve, which is connected to the portion of a fuel passage which is between the low-pressure accumulator and fuel tank, of the low-pressure accumulator so that the fuel pressure in the low-pressure accumulator attains a predetermined level.

A case where the change-over valve provided correspondingly to the injector in each cylinder and adapted to switch a fuel injection rate gets out of order in the accumulator type fuel injection system of the above-described construction adapted to control an injection waveform by switching the low-pressure and high-pressure accumulators from one to the other will be discussed. When the change-over valve in one cylinder out of, for example, six cylinders or four cylinders gets out of order, the fuel injection pressure and fuel injection rate in the mentioned cylinder become abnormal in comparison with those in the remaining cylinders, and a decrease in the engine output and an increase in the fluctuation of torque occur in consequence, so that the engine cannot be normally operated. When the operation of the engine continues to be carried out in such an abnormal condition, damage to the engine or the vehicle occurs in some cases due to an overload, an increase in the exhaust gas temperature and the like.

When the pressure control valve provided in the low-pressure accumulator gets out of order after the valve is closed, the fuel pressure in the low-pressure accumulator increases, and finally becomes equal to that in the high-pressure accumulator. Consequently, high-pressure injection is carried out from an initial injection period, and the fuel injection rate becomes high to cause the engine to be subjected to an overload operation. Therefore, when the engine continues to be operated in such an abnormal condition, the engine or the vehicle is damaged in some cases. Since a permissible pressure resistance (permissible pressure) of the low-pressure accumulator is set lower than that of the high-pressure accumulator, an excessive increase in the fuel pressure in the low-pressure accumulator has a possibility of occurrence of damage to the low-pressure accumulator and leakage of fuel.

When the pressure control valve gets out of order while it is opened, the execution of low-pressure injection becomes impossible, and the high-pressure injection (main injection) only is carried out. This causes a delay of ignition time, an increase in the exhaust gas temperature and shortage of torque, and exerts ill influence upon the engine. Moreover, due to a necessary operation for increasing the pressure in the low-pressure accumulator, a high-pressure fuel supply pump carries out excessive force feeding of fuel repeatedly, so that there is the possibility that the high-pressure fuel supply pump gets out of order.

When a pressure sensor for detecting the fuel pressure in the high-pressure accumulator gets out of order (for example, the breaking of wire occurs) with a signal output at a low level in the accumulator type fuel injection system of the above-described construction adapted to control an injection waveform by switching the low-pressure and high-pressure accumulators from one to the other during a fuel injection operation, the fuel pressure in the high-pressure accumulator increases due to a necessary operation for controlling the same fuel pressure so that it increases. However, a relief valve provided in the high-pressure accumulator is finally operated, and damage to the high-pressure accumulator and fuel passage can be prevented.

However, the injecting of the fuel is necessarily done at an injection pressure not lower than a maximum level in a regular mode at all times, so that an increase in the injection rate, maximum inside-cylinder pressure and noise vibration occur. Moreover, due to a necessary operation for increasing the fuel pressure in the low-pressure accumulator, the high-pressure fuel pump repeats excessive force feeding of the fuel to give rise to a possibility of the occurrence of an accident.

When the pressure sensor of the high-pressure accumulator gets out of order with a signal output at a high level (high pressure), the fuel pressure in the high-pressure accumulator is necessarily controlled so that it decreases, so that the force feeding of the fuel from the same accumulator stops. Consequently, such a fuel pressure in the high-pressure accumulator that is required to carry out a fuel injection operation cannot be obtained. This makes it impossible to operate the engine.

When a pressure sensor for detecting the fuel pressure in the low-pressure accumulator gets out of order (for example, the breaking of wire occurs) with a signal output at a low level (low pressure), the fuel pressure in the low-pressure accumulator is necessarily controlled so that it increases, so that the fuel pressure in the same accumulator increases, and finally becomes equal to that in the high-pressure accumulator. Consequently, a high-pressure injection operation is carried out from an initial injection period, and the injection rate increases to cause the engine to be subjected to an overload operation. Therefore, when the engine continues to be operated in such an abnormal condition, the engine or the vehicle is damaged in some cases. Since the permissible pressure resistance (permissible pressure) of the low-pressure accumulator is set low with respect to that in the high-pressure accumulator, an excessive increase in the fuel pressure in the low-pressure accumulator gives rise to a possibility of the occurrence of damage to the low-pressure accumulator and the leakage of the fuel.

When the pressure sensor in the low-pressure accumulator gets out of order with a signal output at a high level (high pressure), the fuel pressure in the low-pressure accumulator is necessarily controlled so that it decreases, so that the pressure in the same accumulator reaches so low a level that a low-pressure injection operation cannot be carried out, a high-pressure injection operation only being thereby carried out. This causes a delay of the ignition time, an increase in the exhaust gas temperature and the shortage of torque, and exerts ill influence upon the engine.

SUMMARY OF THE INVENTION

Therefore, the present invention aims at providing an accumulator type fuel injection system adapted to prevent an engine trouble by judging a change-over valve provided correspondingly to a fuel nozzle in each cylinder and adapted to switch a fuel injection rate, a pressure control valve adapted to control a pressure in a low-pressure accumulator, and a fuel pressure detecting means for detecting a fuel pressure in the accumulators as to whether these valves and means break down or not; and carrying out, when they break down, a limp-home mode control operation in which an operational region of the engine is limited.

To achieve this object, the accumulator type fuel injection system according to the present invention has an accumulator adapted to store therein a fuel pressurized by a fuel pump, and a fuel injection valve to which the fuel stored in the accumulator is supplied, the fuel stored in the accumulator being injected from the fuel injection valve into a combustion chamber, the fuel injection system comprising a first accumulator adapted to store therein a high-pressure fuel pressurized by said fuel pump, a plurality of fuel injection valves connected to the first accumulator via a plurality of fuel passages and having nozzles for injecting the fuel into the combustion chambers of the engine, a plurality of first control valves provided in the fuel passages and adapted to control the discharging of the high-pressure fuel in the first accumulator to a downstream side of the fuel passages, a second accumulator adapted to store therein a fuel the pressure of which is lower than that of the high-pressure fuel in the first accumulator and connected via branch passages to the portions of the fuel passages which are on the downstream side of the first control valves, a second control valve adapted to control the discharging of the low-pressure fuel in the second accumulator to an atmosphere-opened side, a failure detecting means for detecting the occurrence of failure in the accumulator type fuel injection system, and a fuel control means adapted to control, during a regular operation of the engine, an operation for opening the first control valves in the midst of a period of time in which the fuel injection nozzles are opened and an operation for closing the first control valves simultaneously with the closure of the fuel injection nozzles, and set, when the occurrence of failure in the accumulator type fuel injection system is detected by the failure detecting means, a pressure of the fuel discharged from the fuel pump so that a fuel pressure in the fuel passages becomes not higher than a permissible pressure in the second accumulator.

When failure occurs in the accumulator type fuel injection system, the pressure in the fuel passages is maintained at a level not higher than that of a permissible pressure in the second accumulator at all times owing to this arrangement, so that the occurrence of engine trouble and damage to a vehicle can be prevented.

When the failure detecting means is formed so that it judges that at least one of the first control valves has got out of order, the exertion of a pressure of not lower than a permissible level on the second accumulator which occurs due to the execution of the high-pressure injection only of a fuel into, for example, the relative cylinder during a breakdown of the first control valve can be prevented.

When the failure detecting means is formed so that it judges that the second control valves have got out of order in a closed state, the occurrence of an uncontrollably high pressure in the second accumulator during a breakdown of the second control valves can be prevented.

When the fuel control means is formed so that it judges when a rate of opening of the second control valve with respect to a set pressure in the second accumulator is out of a reference region that the failure detecting means has got out of order when the controlling of the opening of the first control valves is done so as to discharge the high-pressure fuel in the first accumulator toward the second accumulator and when the controlling of the opening of the second control valve is done in accordance with an output from a fuel pressure detecting means, which is further provided for detecting the fuel pressure in the second accumulator, in such a manner that the fuel pressure in the second accumulator attains the set level, it becomes possible to judge the abnormality of the fuel pressure in the portions of the fuel passages which are between the first control valves and fuel injection nozzles, and prevent the occurrence of a breakdown of the engine and damage to a vehicle.

When the failure detecting means is formed so that it judges the occurrence of a breakdown of a first fuel pressure detecting means further provided for detecting the fuel pressure in the first accumulator, and, when the fuel control means is formed so that it controls by closing the second control valve when the breakdown of the first fuel pressure detecting means is detected by the failure detecting means the pressure of the fuel discharged from the fuel pump in accordance with an output from a second fuel pressure detecting means, which is further provided for detecting the fuel pressure in the second accumulator, in such a manner that the fuel pressure in the fuel passages reaches a level not higher than that of the permissible pressure of the second accumulator, the second accumulator is not damaged even when the first fuel detecting means gets out of order.

In addition, when the failure detecting means is formed so that it judges that the first fuel pressure detecting means gets out of order when a ratio of an average value of an absolute value of a variation rate with the lapse of time of an output from the first fuel pressure detecting means to an average value of an output therefrom is not higher than a predetermined level with a difference between the value of an output from the first fuel detecting means and a set pressure in the first accumulator not lower than a predetermined level, a failure judging accuracy can be improved.

DESCRIPTION OF THE PREFERRED EMBODIMENT

A preferred embodiment of the present invention will now be described in detail illustratively with reference to the drawings.

Figure 1:
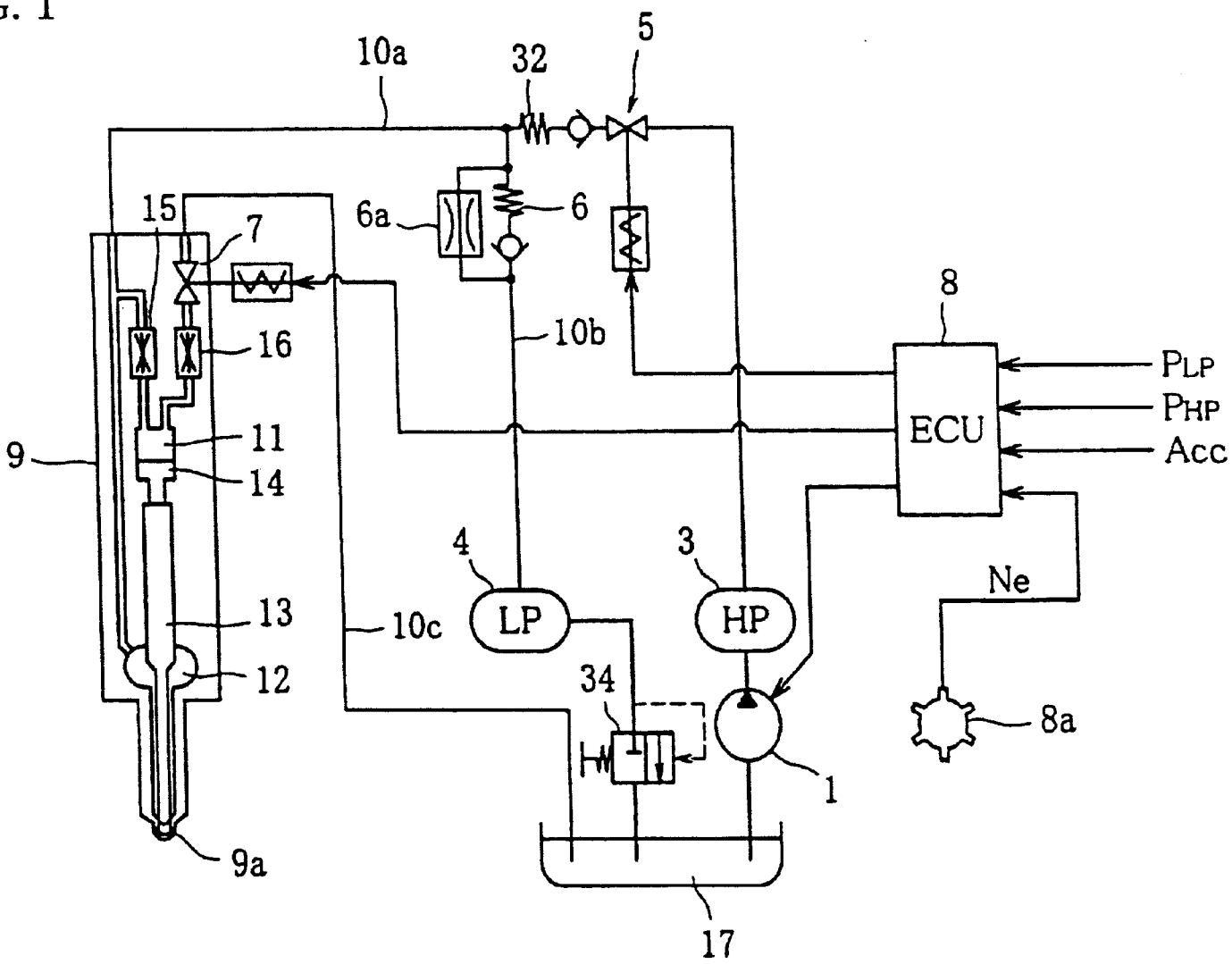
FIG. 1 is a schematic diagram showing a mode of embodiment of the accumulator type fuel injection system according to the present invention.
Figure 2:
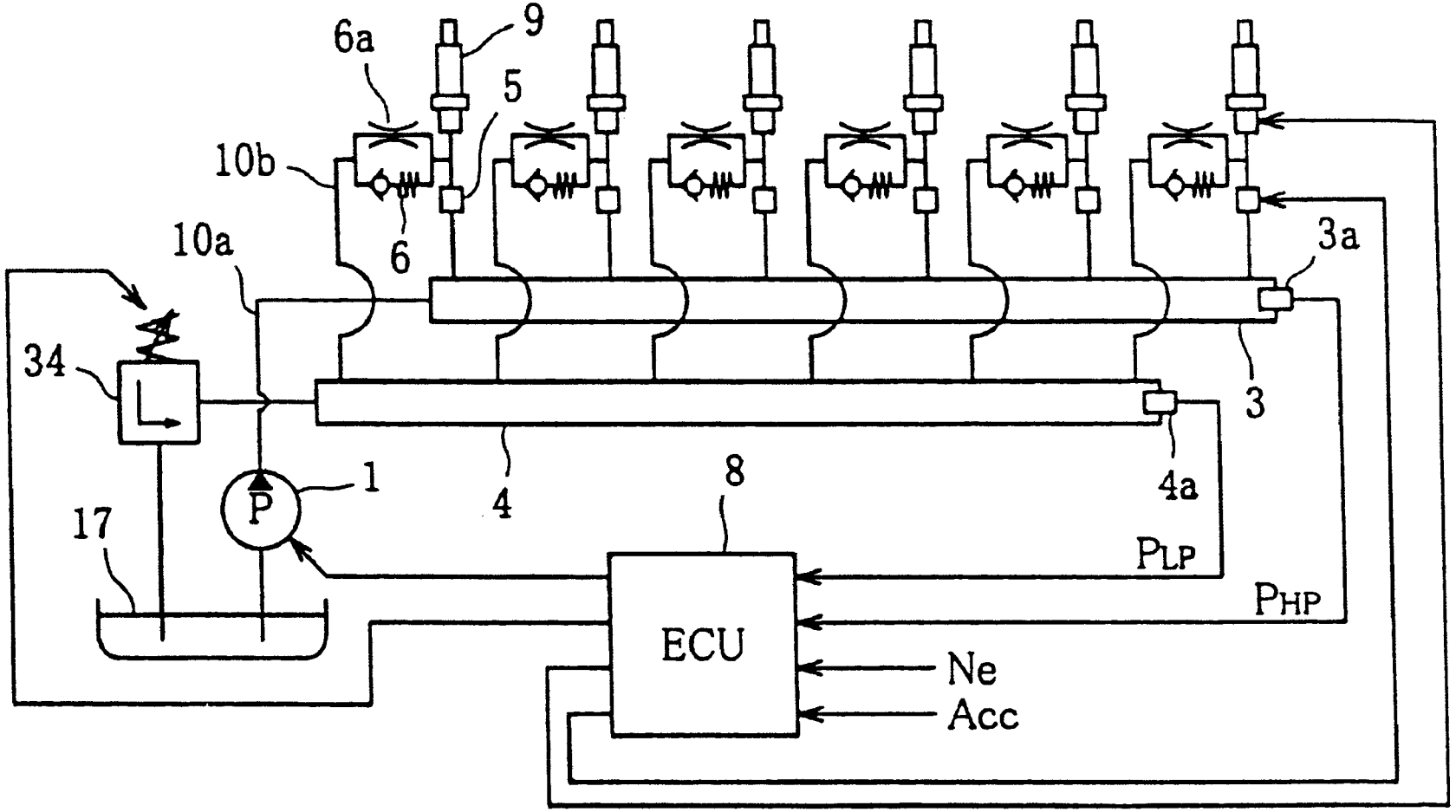
FIG. 2 is a schematic diagram showing the connection of main elements of the fuel injection system of FIG. 1 to injectors in respective cylinders of an engine.

FIG. 1 is a schematic construction diagram of a mode of embodiment of the accumulator type fuel injection system according to the present invention, and FIG. 2 a schematic diagram showing the connection of the main elements of the fuel injection system of FIG. 1 to injectors in the respective cylinders of an engine.

Figure 3:
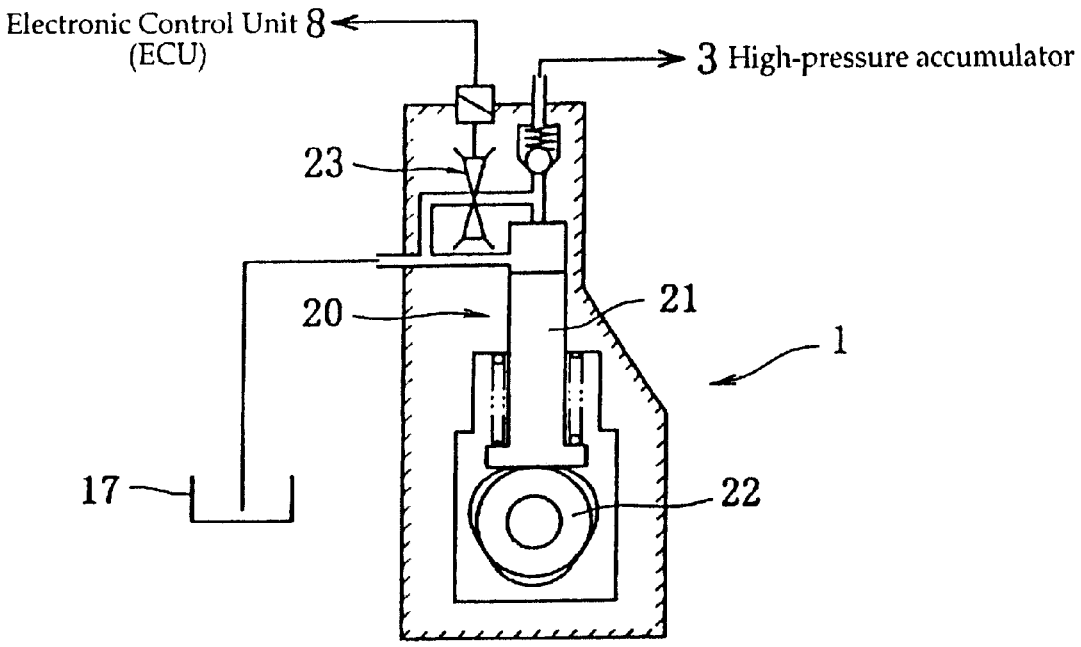
FIG. 3 is a schematic diagram of a high-pressure pump shown in FIG. 1.

Referring to FIGS. 1 and 2, the accumulator type fuel injection system is mounted on, for example, a six-series-cylinder diesel engine (not shown). A high-pressure pump 1 is provided with two plunger pumps 20 shown, for example, in FIG. 3, and these plunger pumps 20 correspond to three front cylinders and three rear cylinders respectively of the six-series-cylinder engine, cams 22 for driving the plunger 21 for the three front cylinders and the plunger 21 for the three rear cylinders being provided with three bulging portions respectively. Each plunger 21 executes three force feed strokes while a shaft of the high-pressure pump makes one revolution, to force feed a fuel. The regulation of the force feed stroke is carried out by regulating the closing time of an electromagnetic valve 23 provided on the discharge side of the plunger pumps 20, and while this electromagnetic valve 23 is opened, the force feed operations of the plunger pumps 20 are rendered ineffective. The electromagnetic valve 23 is controlled by an electronic control unit 8 which will be described later.

Returning to FIG. 1, the electronic control unit (ECU) 8 as a control means for the accumulator type fuel injection system is adapted to regulate the force feed stroke variably by controlling the electromagnetic valve 23 of the high-pressure pump 1 in accordance with an engine speed Ne detected by an engine speed sensor 8*a* and an accelerator pedal stepping amount (degree of opening of an accelerator) Acc detected by a degree of opening of an accelerator sensor (not shown), and feedback control the force feed stroke (discharge pressure) in accordance with a fuel pressure PHP detected by a pressure sensor (first fuel pressure detecting means) 3*a* provided in a first accumulator 3, whereby a high-pressure fuel suiting the operating condition of the engine is obtained.

The fuel pressurized by the high-pressure pump 1 is stored in the high-pressure accumulator 3. This high-pressure accumulator 3 is common to all cylinders, and communicates with fuel passages 10*a*. The fuel passages 10*a* are provided in intermediate portions thereof with fuel injection rate switching change-over valves (first control valves) 5, which comprise, for example, two-way electromagnetic valves, correspondingly to the respective cylinders (FIG. 2), and check valves 32 adapted to allow a fuel to flow from the upstream side to the downstream side are provided in the portions of the fuel passages which are on the immediate downstream side of the change-over valves 5.

A low-pressure accumulator (second accumulator) 4 common to all cylinders is connected to the portions of the fuel passages 10*a* which are on the downstream side of the check valves 32, via fuel passages 10*b* branching from the fuel passages 10*a*. The fuel passages 10*b* are provided in intermediate portions thereof with check valves 6 and bypass passages shunting the check valves 6, these bypass passages being provided with orifices 6*a*. The check valves 6 allow a fuel to flow only from the low-pressure accumulator 4 toward the fuel passages 10*a*. When the fuel pressure in the fuel passages 10*a* is higher than that in the fuel passages 10*b*, the fuel in the fuel passages 10*a* flows into the fuel passages 10*b* through the orifices 6*a*, and then into the low-pressure accumulator 4. The fuel passages 10*b* are provided in the portions thereof which are between the low-pressure accumulator 4 and a fuel tank 17 with a pressure control valve (second control valve) 34 adapted to be operated under the control of the electronic control unit 8 and control the fuel pressure in the low-pressure accumulator 4. As shown in FIG. 2, the low-pressure accumulator 4 is provided with a pressure sensor 4*a* (second fuel pressure detecting means) adapted to detect a fuel pressure PLP in the low-pressure accumulator 4.

The electronic control unit 8 is adapted to control the pressure control valve 34 on the basis of an actual pressure PLP detected by the pressure sensor 4*a* so that the fuel pressure in the low-pressure accumulator 4 attains a pressure suiting the operating condition of the engine represented by an engine speed Ne and an accelerator pedal stepping amount Acc.

An injector 9 as a fuel injection nozzle provided in each cylinder of the engine has a pressure control chamber 11 connected to the relative fuel passage 10*a* via an orifice 15, and a fuel chamber (fuel reservoir) 12, and the pressure control chamber 11 is connected to the fuel tank 17 via an orifice 16 and a fuel return passage 10*c*. A fuel injection period control switch valve 7 comprising, for example, a two-way electromagnetic valve is connected to an intermediate portion of the fuel return passage 10*c*. The switch valve 7 may also be provided in the injector.

The injector 9 has a needle valve 13 adapted to open and close a nozzle (injection port) 9*a*, and a hydraulic piston 14 slidably housed in the pressure control chamber 11, and the needle valve 13 is closed by being urged toward the nozzle 9*a* by a spring (not shown). When the fuel is supplied from the fuel passage 10*a* to the pressure control chamber 11 and fuel chamber 12 with the injection period control switch valve 7 closed, a resultant force of the resilient force of the mentioned spring and fuel pressure is applied to the needle valve 13, which closes the nozzle 9*a* against the fuel pressure in the fuel chamber 12. When the switch valve 7 is opened to cause the fuel in the pressure control chamber 11 to be discharged to the side of the fuel tank 17 (atmosphere-opened side), the needle valve 13 is moved toward the hydraulic piston 14 against the resilient force of the spring due to the fuel pressure in the fuel chamber 12 to open the nozzle 9*a*, so that the fuel in the fuel chamber 12 is injected from the nozzle 9*a* into a combustion chamber of the engine.

The operation in a regular mode of the fuel injection system of the above-described construction will now be described.

Under the control of the electronic control unit 8, the fuel pressure in the high-pressure accumulator 3 and that in the low-pressure accumulator 4 are controlled so that these pressures suit the operating condition of the engine, and a fuel injection period (fuel injection starting and finishing time) and a low-pressure injection period are set in accordance with the operating condition of the engine (engine speed and accelerator pedal stepping amount).

Figure 4:
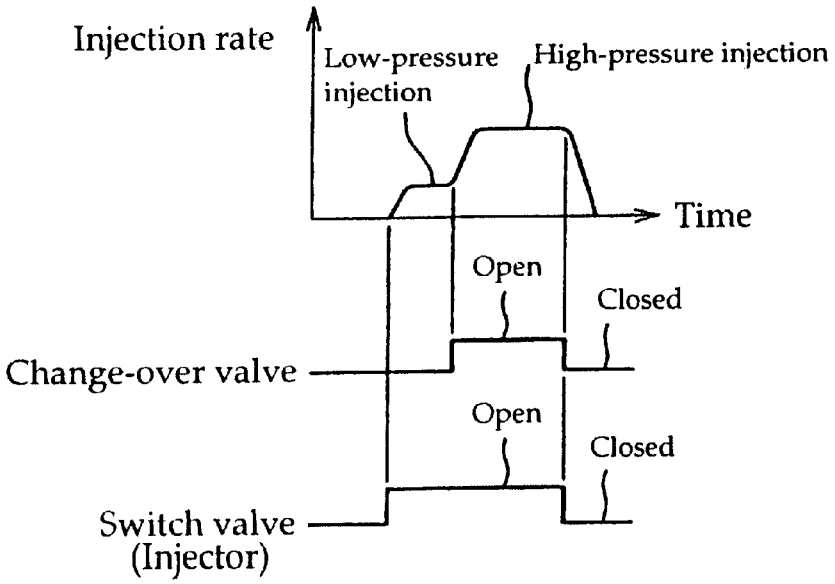
FIG. 4 is a diagram showing variation with the lapse of time of an injection rate, and opened and closed condition of injection rate switching change-over valves and injection period control switch valves in one fuel injection cycle executed in a regular mode.

As shown in FIG. 4, the change-over valve 5 and switch valve 7 are all closed until the fuel injection starting time has come, and a low-pressure fuel is supplied from the low-pressure accumulator 4 to the portion of the fuel passage 10*a* which is on the downstream side of the change-over valve 5, this low-pressure fuel being supplied to the pressure control chamber 11 and fuel chamber 12 in the injector 9. Since the switch valve 17 is closed, the fuel supplied to the interior of the pressure control chamber 11 is applied to the needle valve 13 via the hydraulic piston 14, and the nozzle 9*a* is closed with the needle valve 13, whereby the injector is closed.

When the fuel injection starting time comes, the switch valve 7 only is opened, and the low-pressure fuel in the pressure control chamber 11 of the injector 9 is discharged to the fuel tank 17 through the orifice 16 and fuel return passage 10*c*. Consequently, when a resultant force of the fuel pressure applied to the needle valve 13 via the hydraulic piston 14 and the resilient force of the spring becomes smaller than the fuel pressure in the fuel chamber 12 which works so as to lift the needle valve 13, the needle valve 13 moves up to open the nozzle 9*a*, from which the low-pressure fuel is injected. Namely, low-pressure injection with a comparatively low fuel injection rate (amount of fuel injected per unit time) is carried out in an initial injection period. Owing to this low-pressure injection, the combustion in an initial stage of the fuel injection period is carried out comparatively slowly, and the reduction of the NOx content of an exhaust gas is attained.

When a predetermined period of time elapses after the starting of the low-pressure injection, the injection rate switching change-over valve 5 is opened with the injection period control switch valve 7 left open, and a high-pressure fuel is supplied to the fuel chamber 12 and injected from the injector 9. Namely, high-pressure injection with an injection rate higher than that in the case of low-pressure injection is carried out.

When the fuel injection finishing time comes, the injection period control switch valve 7 is closed, the high-pressure fuel supplied from the fuel passage 10*a* to the pressure control chamber 11 through the orifice 15 works on the needle valve 13 via the hydraulic piston 14 to cause the nozzle 9*a* to be closed therewith, so that the fuel injection from the nozzle 9*a* finishes. At the fuel injection finishing point in time, the fuel injection rate suddenly falls, and rates of discharge of black smoke and particulates (granular substances PM) from the engine decrease. The injection rate switching change-over valve 5 is closed simultaneously with the closure of the switch valve 7 at the fuel injection finishing time, or at a point in time at which a predetermined period of time has elapsed after the fuel injection finishing time.

Figure 5:
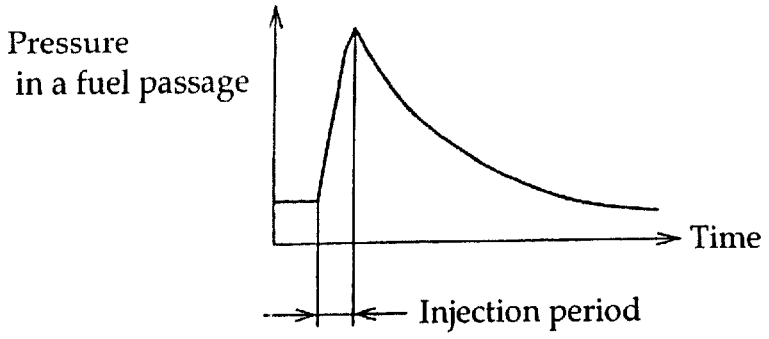
FIG. 5 is a diagram showing variation with the lapse of time of a fuel pressure in the portions of fuel passages which are between the injectors and change-over valves in one fuel injection cycle executed in a regular mode.

As shown in FIG. 5, the high-pressure fuel in the portion of the fuel passage 10*a* which is between the fuel chamber 12 of the injector 9 and the fuel injection rate switching change-over valve 5 flows into the low-pressure accumulator 4 through the orifice 6*a* in the fuel passage 10*b*. Consequently, the fuel pressure in the fuel passage 10*a* gradually decreases from the fuel injection finishing point in time in each fuel injection cycle to a level which suits low-pressure injection, and which is set by the pressure control valve 34 by the time the fuel injection in a subsequent fuel injection cycle has been started, so that the injection rate in the subsequent low-pressure injection reaches a required level.

As has already been described, when the fuel injection rate switching change-over valve provided correspondingly to the injector in each cylinder gets out of order, for example, when a change-over valve 5-1 in a first cylinder out of the six cylinders shown in FIG. 2 gets out of order, the fuel injection pressure and fuel injection rate with respect to the first cylinder become abnormal as compared with those with respect to the remaining cylinders to cause a decrease in the engine output and an increase in the torque fluctuation to occur. Therefore, the engine cannot be operated normally.

Figure 6:
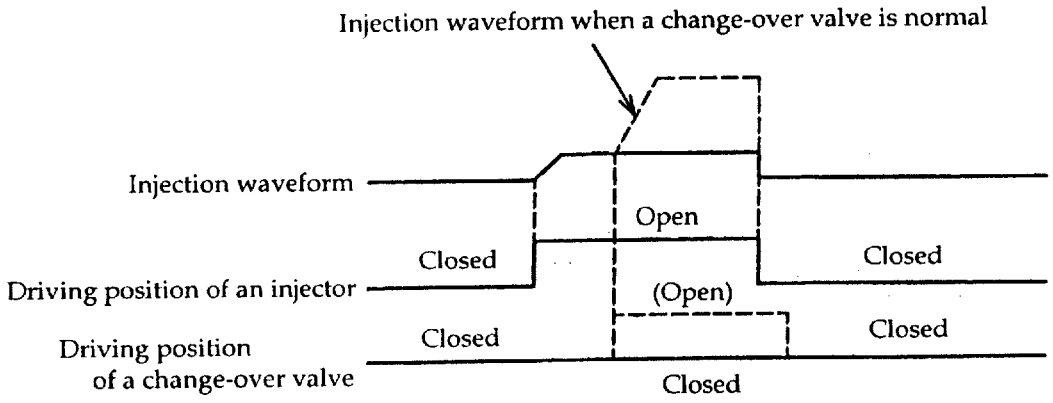
FIG. 6 is a timing chart showing a fuel injection waveform and the driving of the injectors and change-over valves in a case where a change-over valve has got out of order in a closed state.

Namely, in the controlling of the injector and change-over valve, an injection waveform obtained in a case where the change-over valve 5-1 in the first cylinder gets out of order in a closed state shows abnormal injection in which low-pressure injection alone is carried out with high-pressure injection not carried out as shown in FIG. 6 in contrast to an injection waveform (shown by a broken line) obtained in any of the remaining cylinders in which the change-over valves are in a normal condition. Therefore, high-pressure injection cannot be carried out in only the first cylinder provided with the change-over valve 5-1, and the fuel injection rate in this cylinder becomes low as compared with those in the remaining cylinders. Since the quantity of fuel in only one of the six cylinders thus becomes small, the fluctuation of torque becomes large, so that the vibration of the engine becomes large. FIG. 6 is a timing chart showing a fuel injection waveform and the driving of the injector 9 and change-over valve 5-1 of FIG. 2 in a case where the change-over valve 5-1 gets out of order in a closed state.

Figure 7:
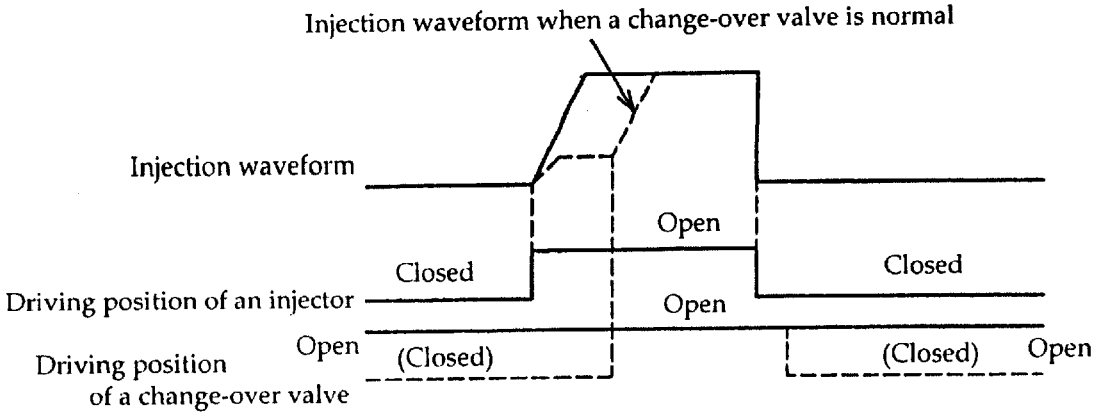
FIG. 7 is a timing chart showing a fuel injection waveform and the driving of the injectors and change-over valves in a case where a change-over valve has got out of order in an opened state.

An injection waveform obtained when the change-over valve 5-1 gets out of order in an opened state shows high-pressure injection only in which low-pressure injection is not carried out as shown in FIG. 7 in contrast to the waveform (shown by a broken line) obtained in the cylinders in which the change-over valves are in a normal condition. Therefore, the quantity of fuel in the first cylinder only in which the change-over valve 5-1 is provided becomes larger than those in the remaining cylinders. Since the quantity of fuel in only one cylinder out of the six cylinders becomes large, the fluctuation of torque becomes large to cause the vibration of the engine to increase. Moreover, only the first cylinder in which the change-over valve 5-1 gets out of order injects the fuel at a rate exceeding a set level, so that the first cylinder only is put in an overload condition to give rise to a possibility of the occurrence of the seizure of the engine. FIG. 7 is a timing chart showing a fuel injection waveform and the driving of the injector 9 and change-over valve 5-1 in a case where the change-over valve 5-1 of FIG. 2 gets out of order in an opened state.

Thus, when any one of the change-over valves 5 gets out of order in either closed state or opened state, the combining of low-pressure injection and high-pressure injection cannot be done, and the injection rate of the cylinder in question becomes abnormal with respect to that of the remaining cylinders in which the change-over valves are in a normal condition.

Figure 9:
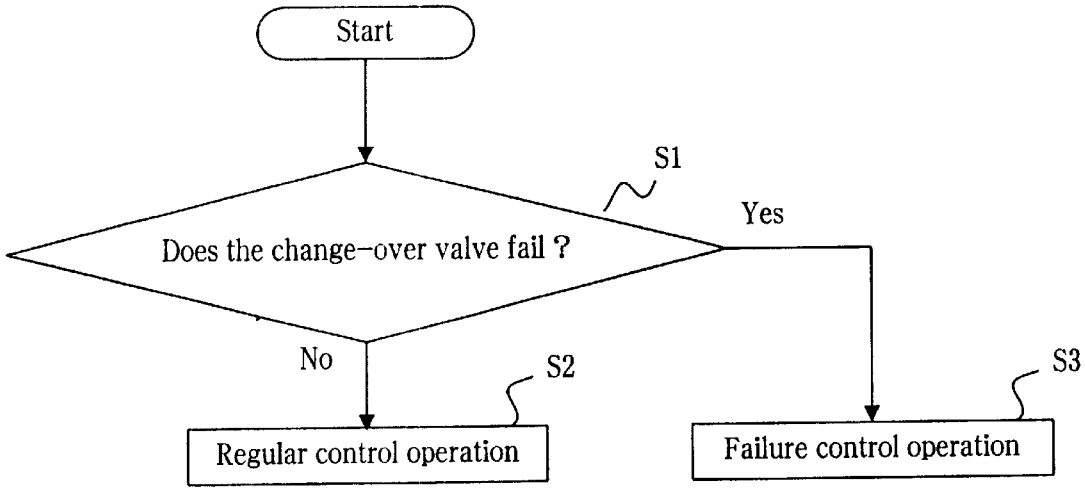
FIG. 9 is a flow chart of a failure judgement routine for the change-over valves in the accumulator type fuel injection system of FIG. 1.

Therefore, the electronic control unit 8 in the accumulator type fuel injection system according to the present invention is adapted to execute the failure judgement routine for the change-over valves of FIG. 9 in a predetermined cycle. In this judgement routine, the injection rate switching change-over valve 5 for switching the injection of a high-pressure fuel and that of a low-pressure fuel from one to the other is judged (Step S1) as to whether it is normal or not. When the change-over valve 5 is normal, the operation is transferred (Step S2) to a regular control mode, and, when the change-over valve 5 breaks down, the operation is transferred (Step S3) to a failure time control mode (limp-home mode).

The failure judgement of the change-over valve 5 in Step S1 is made by monitoring the load condition of the pressure control valve 34, which is adapted to control the fuel pressure in the low-pressure accumulator 4, by the electronic control unit 8. This failure judgement of the change-over valve 5 is made in two cases including a case where the change-over valve breaks down in a closed state and a case where it breaks down in an opened state.

When the change-over valve 5-1 breaks down in a closed state, the supplying of the high-pressure fuel from the fuel passage 10*a* to the low-pressure accumulator 4 decreases by a quantity thereof supplied through the change-over valve 5-1. Therefore, unless the quantity of fuel discharged to the fuel tank 17 is reduced by setting a duty ratio (valve opening ratio) of the pressure control valve 34 (FIGS. 1 and 2), which is adapted to control the fuel pressure in the low-pressure accumulator 4, lower (set the valve closing period longer) than that in a regular condition, the fuel pressure in the low-pressure accumulator 4 does not reach a set level. Accordingly, the duty ratio (load) of the pressure control valve 34 becomes small.

When the change-over valve 5-1 breaks down in an opened state, the quantity of the high-pressure fuel supplied from the fuel passage 10*a* to the low-pressure accumulator 4 increases by a quantity thereof supplied through the change-over valve 5-1. Therefore,unless a large quantity of fuel is discharged to the fuel tank 17 by setting the duty ratio of the pressure control valve 34, which is adapted to control the fuel pressure in the low-pressure accumulator 4, higher (set the valve opening period longer) than that in a regular condition, the fuel pressure in the low-pressure accumulator 4 does not reach a set level. Accordingly, the duty ratio (load) of the pressure control valve 34 becomes large.

Figure 10:
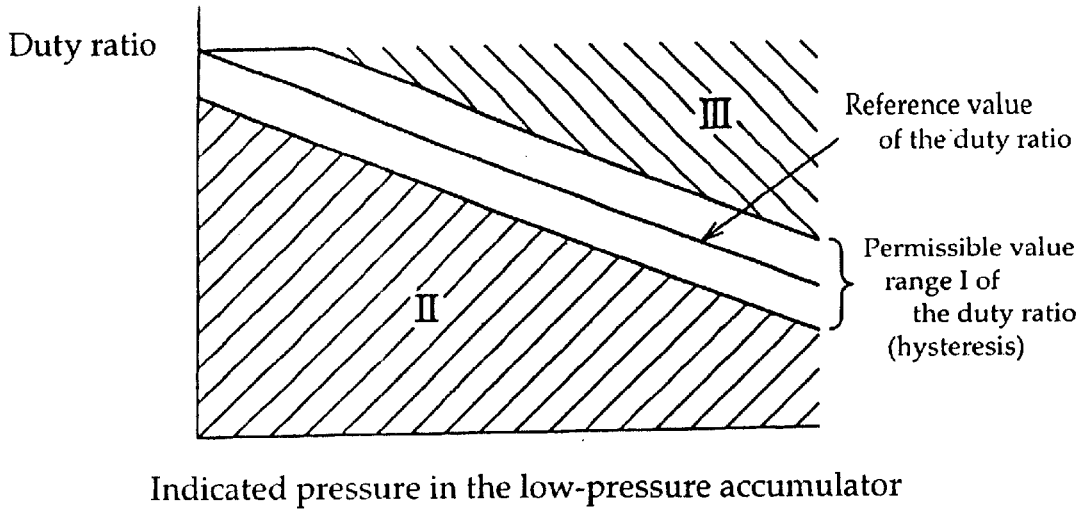
FIG. 10 is a characteristic diagram showing the relation between an indicated pressure in a low-pressure accumulator and a duty ratio (load) of a pressure control valve.

FIG. 10 shows the relation between an indicated pressure in the low-pressure accumulator 4 and the duty ratio (load) of the pressure control valve 34. Referring to FIG. 10, a solid line represents reference values (theoretical valve opening ratios) of the duty ratio of the pressure control valve 34 in a normal condition, and permissible values (hysteresis) of the duty ratio are set on both sides of the solid line to definea reference region I. A region II on the lower side of the reference region I is a region in which the duty ratio of the pressure control valve 34 is small, i.e., the load is small, while a region III is a region in which the duty ratio is large, i.e., the load is large.

When the electronic control unit 8 monitors the duty ratio (load) of the pressure control valve 34 to find out that it is in the region II departing from the reference region I of FIG. 10, the control unit judges that the change-over valve 5 breaks down in a closed state, and, when the duty ratio is in the region III, it judges that the change-over valve 5 breaks down in an opened state. The breakdown of the change-over valve 5 includes a mechanical fault in which a spool sticks to a part due the exposure thereof to a high-pressure fuel, and an electrical fault in which the breaking of wire occurs in a solenoid. It also includes a fault due to the clogged orifice 6*a*. When the breaking of wire occurs in the solenoid of the change-over valve 5, the electronic control unit 8 judges for this reason that the change-over valve 5 breaks down.

Figure 11:
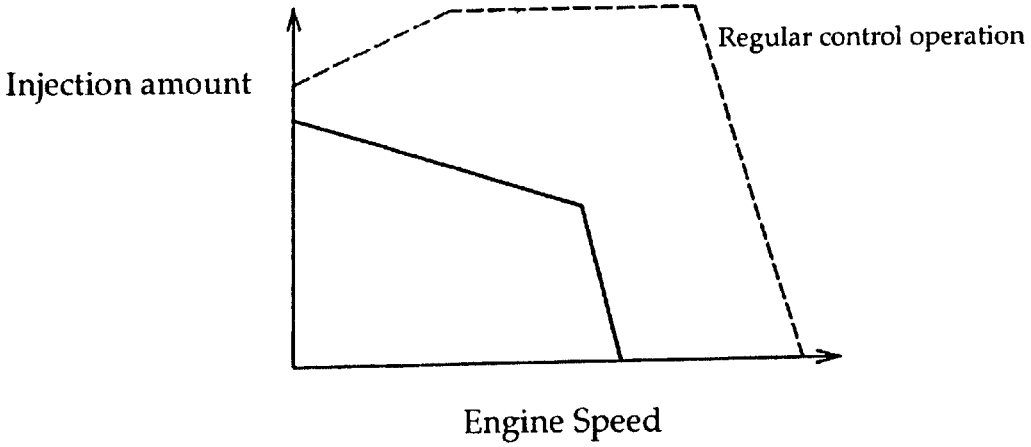
FIG. 11 is a characteristic diagram showing the relation between an engine speed and a fuel injection rate.

The electronic control unit 8 carries out a control operation by switching each control map for the change-over valve 5, which controls the switching of fuel injection amount, injection pressure, injector 9 and fuel injection rate, to a control map for a failure mode in a failure time control mode (limp-home mode) for the change-over valve in Step S3 of FIG. 9. Namely, as shown by a solid line in FIG. 11, the fuel injection amount control operation restricts a maximum injection amount and a maximum engine speed (maximum value) with respect to those in a regular mode (maximum value) shown by a broken line. FIG. 11 is a characteristic diagram showing the relation between the engine speed and the fuel injection amount.

Figure 12:
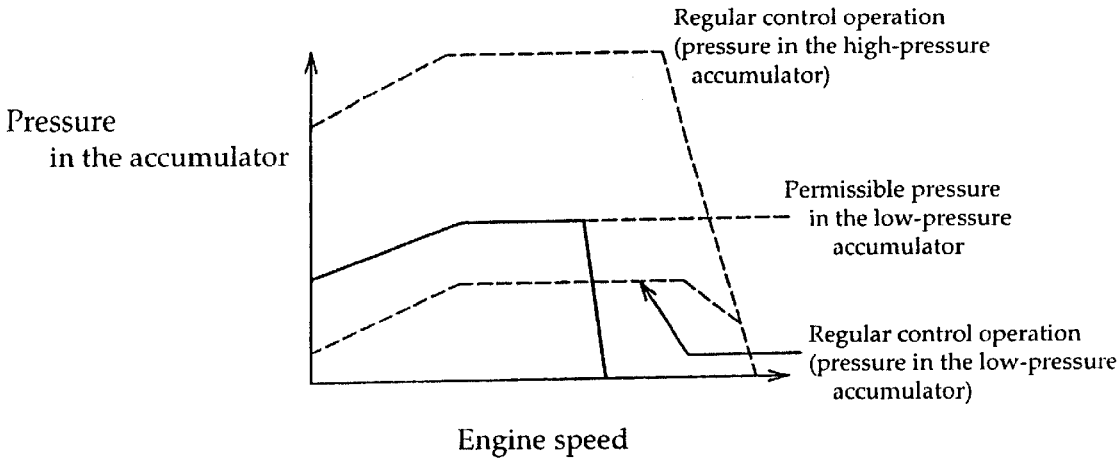
FIG. 12 is a characteristic diagram showing the relation between the engine speed and pressures (fuel pressures) in high-pressure and low-pressure accumulators.

The electronic control unit 8 further controls maximum pressures (fuel pressures) in the high-pressure and low-pressure accumulators 3, 4 so that they attain predetermined levels (which will hereinafter be referred to as "set levels") as shown by a solid line in FIG. 12. A maximum level of this set pressure is lower than that of the fuel pressure in a regular control operation shown by a broken line in the high-pressure accumulator 4, higher than the fuel pressure in the low-pressure accumulator 4 in a regular control operation, and not higher than a permissible withstanding pressure (permissible pressure) of the low-pressure accumulator 4. This set pressure controls the fuel pressure in the high-pressure accumulator 3 by regulating the effective section of the force feed stroke of the plunger 21 (FIG. 3) of the high-pressure pump 1; the fuel pressure in the low-pressure accumulator 4 by controlling the duty ratio of the pressure control valve 34; and the fuel pressures in the high-pressure and low-pressure accumulators 3, 4 so that they become equal to each other. Since a maximum pressure (fuel pressure) in the high-pressure accumulator 3 is thus set not higher than a permissible withstanding pressure of the low-pressure accumulator 4, damage to the low-pressure accumulator 4 and the leakage of fuel are prevented. FIG. 12 is a characteristic diagram showing the relation between the engine speed and the fuel pressures in the high-pressure and low-pressure accumulators 3, 4.

Since a maximum pressure (fuel pressure) in the high-pressure accumulator 3 is thus set not higher than a permissible withstanding pressure of the low-pressure accumulator 4, the fuel injection pressure of a cylinder in which the change-valve 5 breaks down and those of the normal remaining cylinders become equal. Accordingly, a difference in torque between the cylinders is eliminated, and torque fluctuation is minimized, so that the vibration of the engine is minimized.

Figure 8:
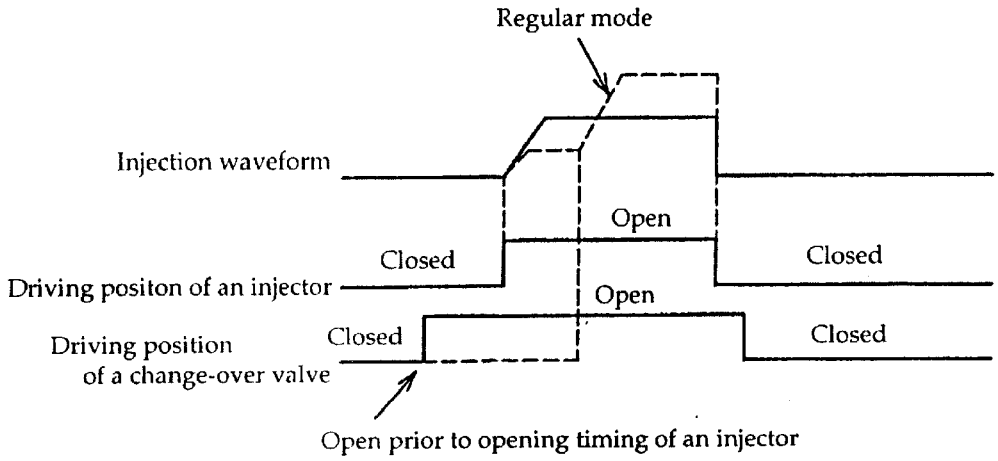
FIG. 8 is a timing chart showing a fuel injection waveform and the driving of the injectors and change-over valves in a failure mode of the change-over valves.

FIG. 8 is a timing chart showing a fuel injection waveform and the driving of the injector 9 and change-over valve 5 in a failure mode of the change-over valve 5. As shown in FIG. 8, the controlling of the switch valve 7 adapted to control the opening period, i.e. injection period of the injector 9 is simplified by using the same map as is used in a regular control operation. The opening time of normal change-over valves 5 is set to the time earlier (advanced time) than that at which the injector 9 is opened (switch valve 7 is opened). This enables the injection waveforms of all the cylinders to be set identical, with the cylinder in which the change-over valve 5 breaks down receiving the supply of fuel the pressure of which is equal to that of the fuel in the remaining cylinders in which the change-over valves 5 are in a normal condition, since the fuel pressures PHP, PLP in the high-pressure and low-pressure accumulators 3, 4 respectively are controlled to be at the same level when the breakdown of the change-over valve 5 occurred in its closed state. When a certain change-over valve 5 breaks down in an opened state, the change-over valves 5 in a normal condition in the remaining cylinders are opened through the whole injection period, so that these cylinders are put in the same condition as the cylinder in which the change-over valve 5 breaks down in an opened state, this enabling the injection waveforms of all the cylinders to be set identical.

Since the electronic control unit 8 thus judges the breakdown of the fuel injection rate switching change-over valve 5 and sets when the breakdown thereof occurs in a limp-home mode, damage to an engine body or an overload on the engine body, and damage to a vehicle due to an increase in the exhaust gas temperature can be avoided. When the change-over valve breaks down, a proper control operation is carried out in a limp-home mode, so that the vehicle can travel by itself to a repair shop with an overload operation of the engine and the variation of rotation thereof restrained.

Figure 13:
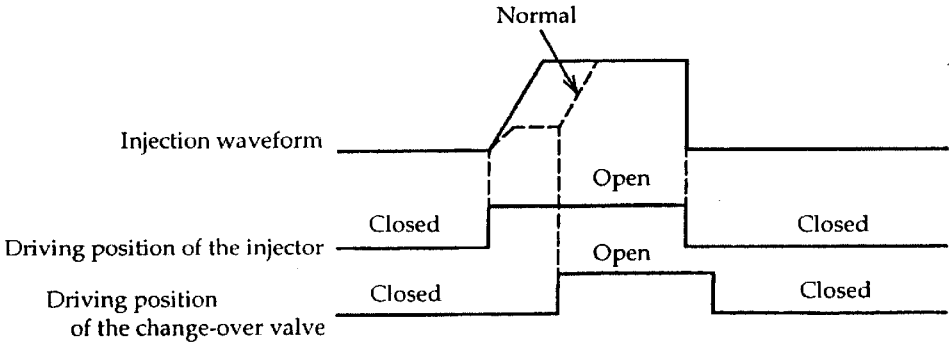
FIG. 13 is a timing chart showing a fuel injection waveform and the driving of the injectors and change-over valves in a case where the pressure control valve has got out of order in a closed state.

When the pressure control valve 34 for controlling the pressure in the low-pressure accumulator 4 breaks down in a closed state, the fuel pressure in the low-pressure accumulator 4 increases to finally reach the level thereof in the high-pressure accumulator 3. The injection waveform obtained when the pressure control valve 34 breaks down in a closed state indicates abnormal injection in which high-pressure injection only is carried out from an initial stage as shown in FIG. 13 in contrast to that (shown by a broken line) in a case where the pressure control valve 34 is in a normal condition. Therefore, the fuel injection amount increases to put the engine in an overload operating condition.

Consequently, when the engine keeps being operated in such an abnormal condition, the engine or the vehicle is damaged in some cases. Since the permissible withstanding pressure of the low-pressure accumulator 4 is set lower than that of the high-pressure accumulator 3, an excessive fuel pressure increase in the low-pressure accumulator 4 gives rise to a possibility of the occurrence of damage to the low-pressure accumulator 4 and the leakage of fuel. FIG. 13 is a timing chart showing a fuel injection waveform and the driving of the injector 9 and change-over valve 5 in a case where the pressure control valve 34 gets out of order in a closed state.

Figure 14:
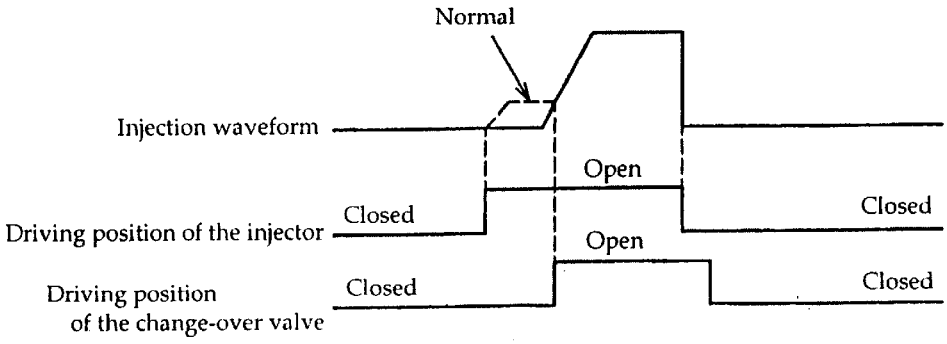
FIG. 14 is a timing chart showing a fuel injection waveform and the driving of the injectors and change-over valves in a case where the pressure control valve has got out of order in an opened state.

When the pressure control valve 34 gets out of order, a low-pressure injection operation cannot be carried out, and the waveform obtained at this time indicates that a high-pressure injection (main injection) operation only is carried out with a low-pressure injection (initial injection) operation not carried out as shown in FIG. 14 in contrast to the injection waveform (shown by a broken line) obtained when the change-over valve is in a normal condition. This causes a delay of ignition time, an increase in the exhaust gas temperature and the shortage of torque, and exerts ill influence upon the engine. Since it is necessary to increase the pressure in the low-pressure accumulator 4, the high-pressure pump 1 carries out excessive fuel force feeding operations repeatedly to cause a possibility of the occurrence of breakdown of the same pump to arise. FIG. 14 is a timing chart showing a fuel injection waveform and the driving of the injector 9 and change-over valve 5 in a case where the pressure control valve 34 gets out of order in an opened state.

Thus, when the pressure control valve 34 gets out of order in either a closed state or an opened state, a combination of low-pressure injection and high-pressure injection cannot be established, and an injection amount becomes abnormal as compared with that in a case where the pressure control valve 34 is in a normal condition.

Figure 15:
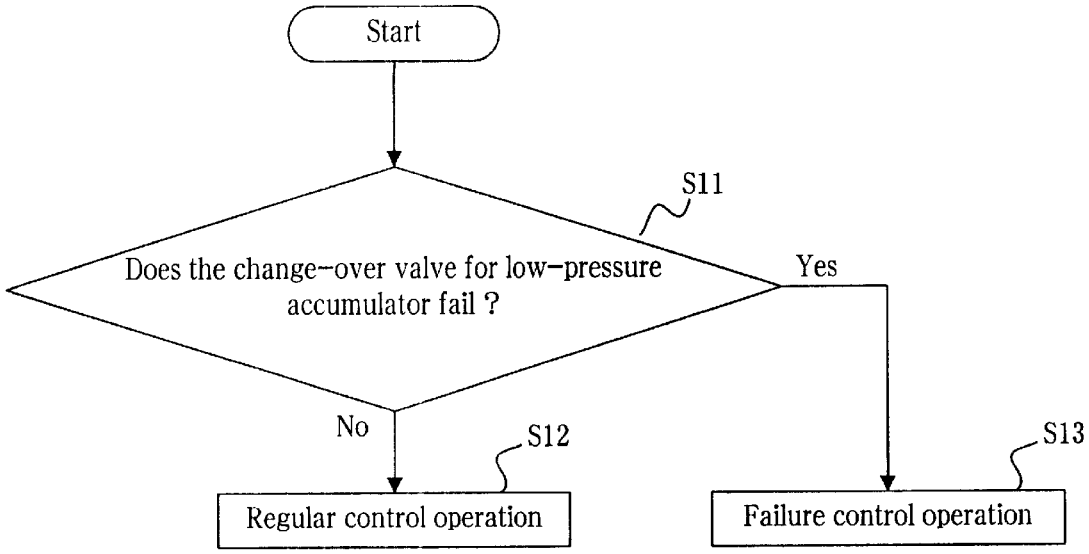
FIG. 15 is a flow chart of a failure judgement routine for the change-over valves of the accumulator type fuel injection system of FIG. 1.

Therefore, in the accumulator type fuel injection system according to the present invention, the electronic control unit 8 executes in a predetermined cycle a failure judgement routine shown in FIG. 15 for the control valve in the low-pressure accumulator. In this judgement routine, the pressure control valve 34 for controlling the fuel pressure in the low-pressure accumulator 4 is judged as to whether it is normal or not (Step S1). When the valve 34 is normal, the control mode is transferred (Step S12) to a regular control mode, and, when the valve 34 gets out of order, the control mode is transferred (Step S13) to a failure time control mode (limp-home mode).

A failure judgement for the pressure control valve 34 in Step S11 is given by monitoring by the electronic control unit 8 the time during which a difference of a level not lower than a certain predetermined level between an actual pressure detected by the pressure sensor 4*a*, which is adapted to detect the fuel pressure in the low-pressure accumulator 4, and an indicated pressure outputted from the electronic control unit 8 is retained. Two failure judgements on the pressure control valve 34 are given which include a failure judgement on a case where the valve gets out of order in a closed state and a failure judgement on a case where the valve gets out of order in an opened state.

When the pressure control valve 34 gets out of order in a closed state, the high-pressure fuel supplied from the fuel passage 10*a* to the low-pressure accumulator 4 is not discharged to the side of the fuel tank 7 (atmosphere-opened side), so that the fuel pressure in the low-pressure accumulator 4 increases. When the condition in which an (actual pressure) in the low-pressure accumulator 4 detected by the pressure sensor 4*a* is higher than (indicated pressure+$\alpha$) continues for a period of time not less than a predetermined period of time, the electronic control unit 8 judges that the pressure control valve 34 gets out of order in a closed stage. The predetermined period of time is follow-up time for monitoring a pressure difference accurately.

When the pressure control valve 34 gets out of order in an opened state, the high-pressure fuel supplied from the fuel passage 10*a* to the low-pressure accumulator 4 is wholly discharged to the side of the fuel tank 7 (atmosphere-opened side), so that the fuel pressure in the low-pressure accumulator 4 decreases. When the condition in which an (actual pressure) in the low-pressure accumulator 4 detected by the pressure sensor 4*a* is lower than (indicated pressure−$\alpha$) continues for a period of time not less than a predetermined period of time, the electronic control unit 8 judges that the pressure control valve 34 gets out of order in an opened state.

Figure 16:
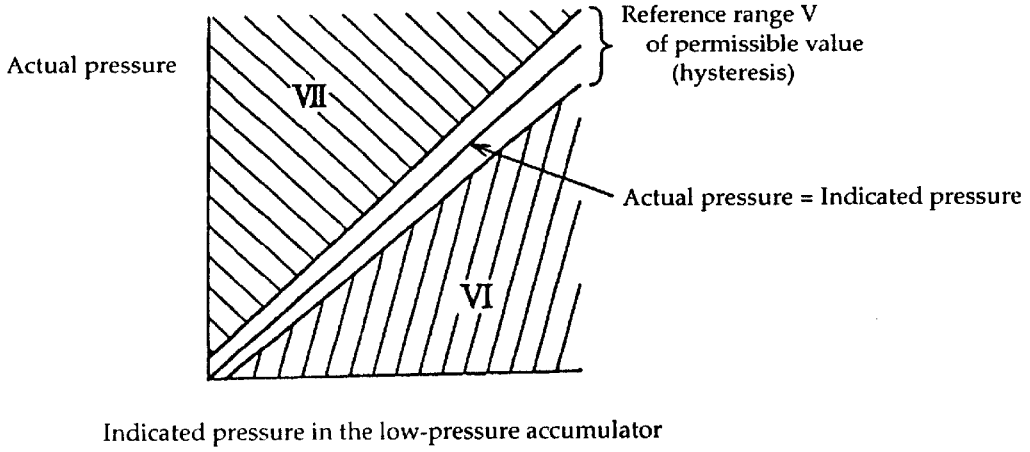
FIG. 16 is a characteristic diagram showing the relation between an indicated pressure and an actual pressure of the low- pressure accumulator.

FIG. 16 shows the relation between the indicated pressure in the low-pressure accumulator 4 and an output (actual pressure) from the pressure sensor 4*a*. Referring to FIG. 16, a solid line shows a reference value of the normal condition of the pressure control valve 34, and permissible values (hysteresis) are set on both sides of the solid line to form a reference region V. A region VI on the lower side of the reference region V is a region in which the actual pressure is smaller than the indicated pressure, and a region VII on the upper side thereof a region in which the actual pressure is larger than the indicated pressure.

The electronic control unit 8 monitors the actual pressure and indicated pressure (set pressure), and, when a differential pressure is in the region VI which is out of the reference region V in FIG. 16, the control unit judges that the pressure control valve 34 gets out of order in an opened state, and, when the differential pressure is in the region VII, it judges that the pressure control valve 34 gets out of order in a closed state. The breakdown of the pressure control valve 34 includes a mechanical fault in which a spool sticks to a part, and an electrical fault due to the breaking of wire in a solenoid. When the breaking of wire occurs in the solenoid of the pressure control valve 34, the electronic control unit 8 judges that the pressure control valve 34 gets out of order in accordance with this fact.

The electronic control unit 8 carries out a control operation in the failure time control mode (limp-home mode) for the pressure control valve 34 in Step S13 of FIG. 15 by switching the control maps for the change-over valve 5, which is adapted to control the switching of a fuel injection amount, an injection pressure, the injector 9 and a fuel injection rate, to maps for a failure mode. Namely, in a fuel injection amount control operation, a maximum injection amount and a maximum engine speed (maximum value) are restricted as shown by a solid line in FIG. 11 with respect to those in a regular mode (maximum value) shown by a broken line.

The electronic control unit 8 further controls the fuel pressures in the high-pressure and low-pressure accumulators 3, 4 to be predetermined levels as shown by a solid line in FIG. 12 in the same manner as in the above-mentioned case where the change-over valve gets out of order. This set pressure is lower than the fuel pressure in the high-pressure accumulator 3 in a regular control period the maximum pressure in which is shown by a broken line; higher than the fuel pressure in the low-pressure accumulator 4 in the regular control period; and not higher than a permissible withstanding pressure (permissible pressure) in the low-pressure accumulator 4, so that, when the pressure control valve 34 gets out of order, damage to the low-pressure accumulator and the leakage of fuel are prevented. This set pressure controls the effective section of the force feed stroke of the plunger 21 of the high-pressure pump 1 (FIG. 1), whereby the pressure (fuel pressure) in the high-pressure accumulator 3 is controlled. Therefore, when the pressure control valve 34 gets out of order in a closed state, the pressure in the high-pressure and low-pressure accumulators 3, 4 becomes equal. When the pressure control valve 34 gets out of order in an opened state, the pressure in the high-pressure accumulator 3 alone reaches a predetermined level, while the pressure in the low-pressure accumulator 4 reaches a level lower than the predetermined level, for example, a level substantially close to that of the atmosphere.

The driving of the injector 9 and change-over valve 5 in the failure mode of the pressure control valve 34 is done in the same manner as in the above-mentioned case where one (change-over valve 5-1) of the change-over valves 5 gets out of order. Namely, as shown in FIG. 8, the controlling of the switch valve 7, which is adapted to control the opening period of the injector 9, i.e. the injection period, is simplified by using the same map as is used in a regular control operation. The opening time of the change-over valve 5 is set to the time in the advancing direction with respect to (earlier than) the opening time of the injector 9 (the opening time of the switch valve 7). This enables the fuel injection to be started at the opening time of the injector 9 both when the pressure control valve 34 gets out of order in a closed state and when the pressure control valve 34 gets out of order in an opened state. Therefore, owing to a combination of such a control operation and an operation for suppressing an increase of the pressure in the high-pressure accumulator 3 (and the operation, which is carried out when the pressure control valve 34 gets out of order, for controlling the fuel pressure (PHP) in the high-pressure accumulator 3 to be the pressure value of the fuel pressure (PLP) in the low-pressure accumulator 4, the occurrence of an excessive increase of the injection amount is prevented when the pressure control valve 34 gets out of order in a closed state, and a delay of injection time when the pressure control valve gets out of order in an opened state.

Figure 17:
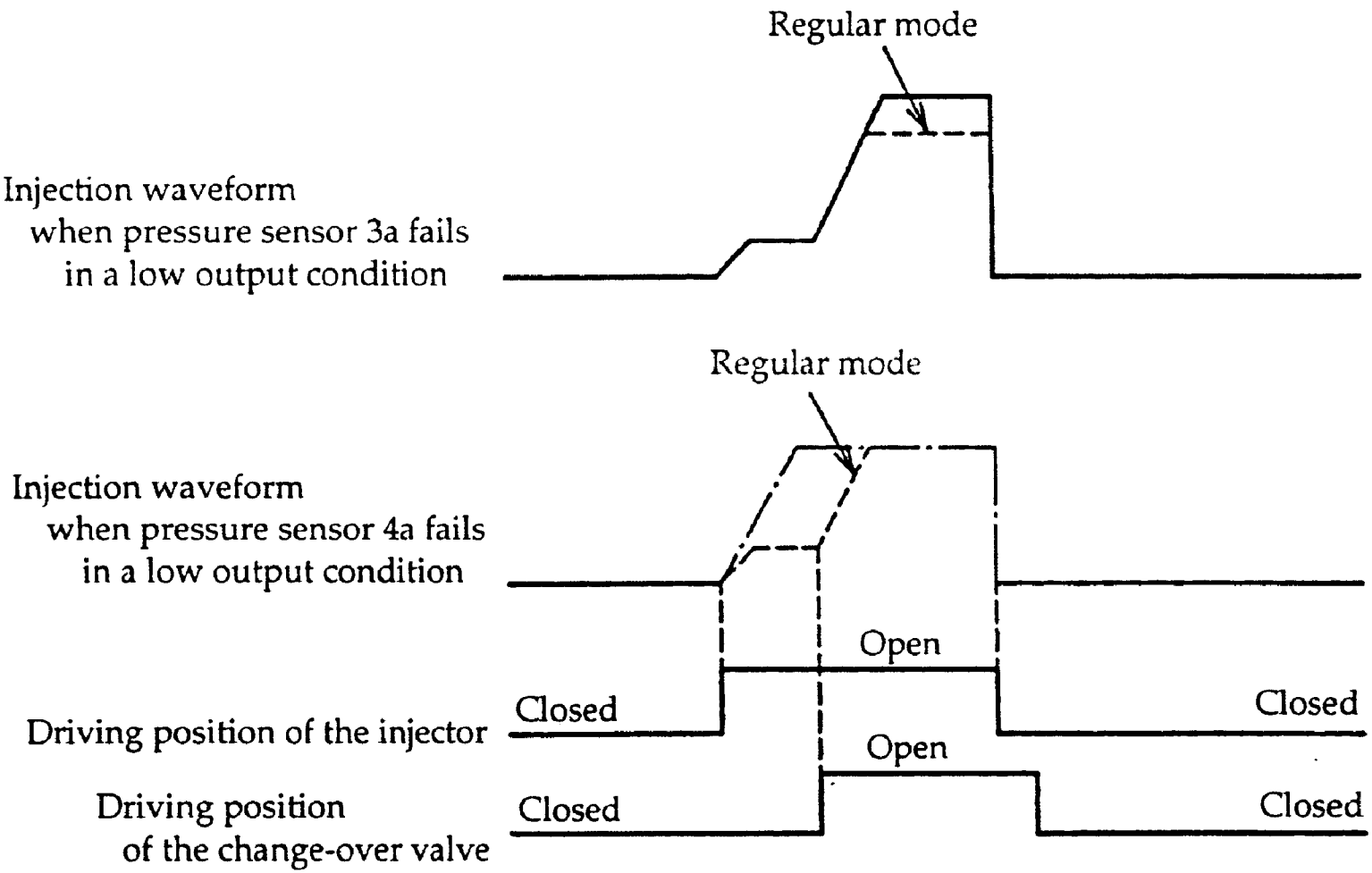
FIG. 17 is a timing chart showing fuel injection waveforms and the driving of the injectors and change-over valves in a case where a pressure sensor of the high-pressure or low-pressure accumulator gets out of order.

As has already been described, when the pressure sensor 3*a* for detecting the fuel pressure in the high-pressure accumulator 3 gets out of order with a signal output at a low level (low pressure), the fuel is injected necessarily at such an injection pressure at all times that is shown by a solid line in FIG. 17 which injection pressure is not lower than a maximum injection pressure, which is shown by a broken line, in a regular mode, and this causes inconveniences including an increase in the injection amount, maximum inside-cylinder pressure and noise vibration. When the pressure sensor 4*a* for detecting the pressure in the low-pressure accumulator 4 gets out of order with a signal output at a low level (low pressure), high-pressure injection is carried out from an initial stage of the injection operation as shown by a one-dot chain line in FIG. 17, i.e., the injection pressure reaches a maximum injection pressure (shown by a broken line) in a regular mode, so that the injection amount increases to cause the engine to be put in an overload operating condition. When the pressure sensor 3*a* for detecting the fuel pressure in the high-pressure accumulator 3 or the pressure sensor 4*a* for detecting the fuel pressure in the low-pressure accumulator 4 thus gets out of order, the combining of low-pressure injection and high-pressure injection cannot be done, and the injection amount becomes abnormal. FIG. 17 is a timing chart showing fuel injection waveforms and the driving of the injector 9 and change-over valve 5 in cases where the pressure sensors 3*a*, 4*a* for detecting the fuel pressure in the high-pressure and low-pressure accumulators 3, 4 respectively get out of order with signal outputs at low levels.

Figure 19:
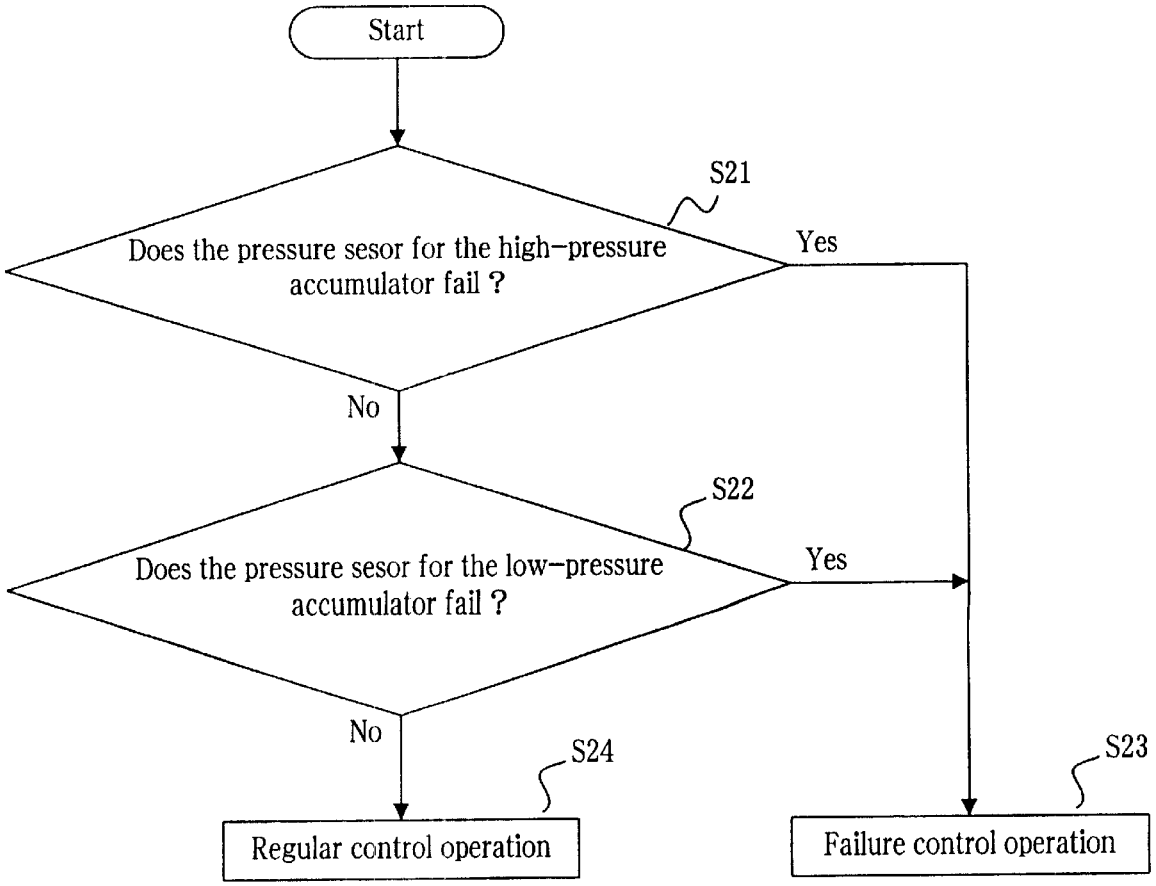
FIG. 19 is a flow chart of a failure judgement routine for the pressure sensors of the high-pressure and low-pressure accumulators of the accumulator type fuel injection system of FIG. 1.

Therefore, in the accumulator type fuel injection system, the electronic control unit 8 is adapted to execute in a predetermined cycle a failure judgement routine shown in FIG. 19 for the accumulator pressure sensors. In the judgement routine shown in FIG. 19, the pressure sensor 3*a* for detecting the fuel pressure in the high-pressure accumulator 3 is judged (Step S21) as to whether it is normal or not. When the pressure sensor 3*a* is normal, the pressure sensor 4*a* for detecting the fuel pressure in the low-pressure accumulator 4 is judged (Step S22) as to whether it is normal or not. When the pressure sensor 4*a* is normal, the control mode is transferred (Step S24) to a regular control mode. When a judgement that the pressure sensor 3*a* breaks down in Step S21, the control mode is transferred (Step S23) to a failure time control mode (limp-home mode).

The failure judgement of the pressure sensor 3*a* in Step S21 is made by monitoring by the electronic control unit 8 a period of time in which a difference of a value of not lower than a certain predetermined level between an actual pressure in the high-pressure accumulator 3 outputted from the pressure sensor 3*a* and an indicated pressure (set pressure) therein is retained, and a ratio of an average value of absolute values of time variation rates of an output from the pressure sensor 3*a* to an average value of the levels of an output therefrom during a certain predetermined period of time.

Namely, a judgement that the pressure sensor 3*a* breaks down is given when two failure conditions, i.e. (1) a difference of a value of not less than a predetermined level between an actual pressure in the high-pressure accumulator 3 and an indicated pressure therein is retained for a period of time not shorter than a predetermined period of time, and (2) a ratio of an average value of variation rates with respect to time of the levels of an output from the pressure sensor 3*a* to an average value of the levels of this output are satisfied at once.

Figure 20:
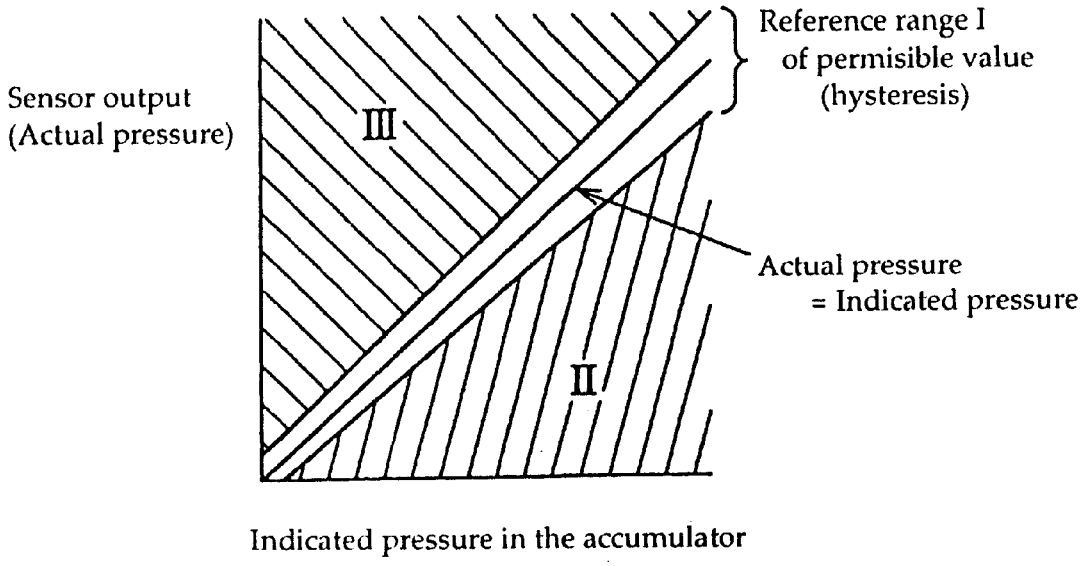
FIG. 20 is a characteristic diagram showing one failure judging condition for the pressure sensor of the high-pressure accumulator and the relation between the indicated pressure in the high-pressure accumulator and an output (actual pressure) from the pressure sensor.

FIG. 20 shows the relation between the indicated pressure in the high-pressure accumulator 3 and an output (actual pressure) from the pressure sensor 3*a*. A solid line in FIG. 20 shows a normal condition (actual pressure=indicated pressure) of the pressure sensor 3*a* with permissible values (hysteresis) set on both sides thereof to form a reference region I. A region II on the lower side of the reference region I is a region in which the actual pressure is lower than the indicated pressure, and a region III a region in which the actual pressure is higher than the indicated pressure. In any of the regions II, III, the first failure condition for the pressure sensor 3*a* is established. The electronic control unit 8 judges that the pressure sensor 3*a* corresponds to the failure condition (first failure condition) of (1) above when the pressure sensor 3*a* continues to be in the region II or III for a period of time not less than a predetermined period of time. Since a judgement that the pressure sensor 3*a* gets out of order is given when it continues to be in the region II or II for a period of time not less than a predetermined period of time, the failure of the pressure sensor 3*a* is judged reliably.

Figure 21:
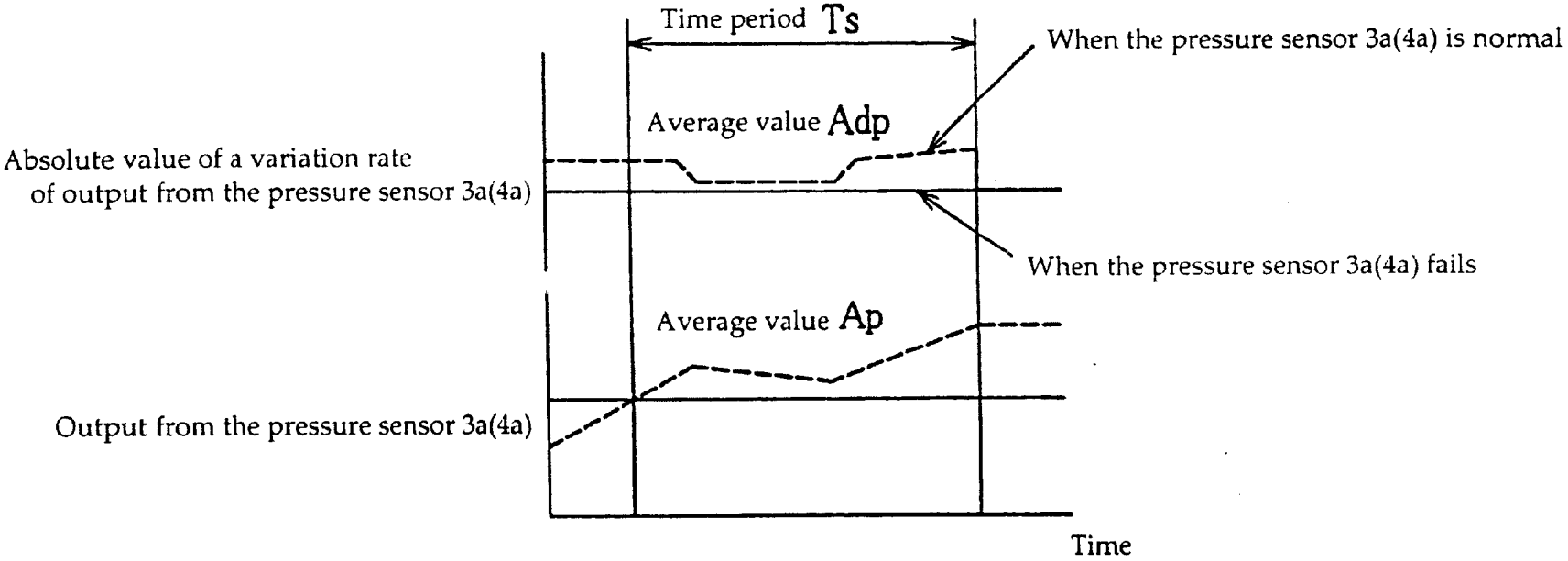
FIG. 21 is a graph showing one failure judging condition for the pressure sensors of the accumulators and variation of outputs from the pressure sensors.

As shown in FIG. 21, let Adp and Ap equal an average value of absolute values of variation rates with respect to the time of the levels of an output from the pressure sensor 3*a* and an average value of the levels of an output therefrom respectively during a certain predetermined period of time Ts. When a ratio R(=Ap/Adp) of these values is not higher than a predetermined level β(R<β), the electronic control unit 8 judges that the pressure sensor 3*a* corresponds to the failure condition (second failure condition) of (2) above. When the pressure sensor 3*a* is normal, an output value from the same varies with the lapse of time, and the average value Adp of absolute values of variation rates with respect to the time of an output therefrom and the average value Ap of the same output vary respectively as shown by broken lines. When the pressure sensor 3*a* is abnormal, the value of an output therefrom becomes constant, and does not vary as shown by a solid line. The output from the pressure sensor 3*a* is made non-dimensional by dividing the average value Ap of the output by the average value Adp of the absolute values of variation rates with respect to the time of the same output. FIG. 21 shows examples of an average value Adp of the absolute values of variation rates with respect to the time of an output from the pressure sensor 4*a* and an average value Ap of an output from the pressure sensor 4*a*.

The manner in which the judging of the failure of the pressure sensor 4*a* is done in Step S22 is completely the same as that in which the judging of the failure of the pressure sensor 3*a* for the high-pressure accumulator 3 is done, so that a description thereof is omitted. Refer to the parenthesized reference numerals 4*a* in FIGS. 20 and 21 concerning the failure judgement of the pressure sensor 4*a*.

Figure 22:
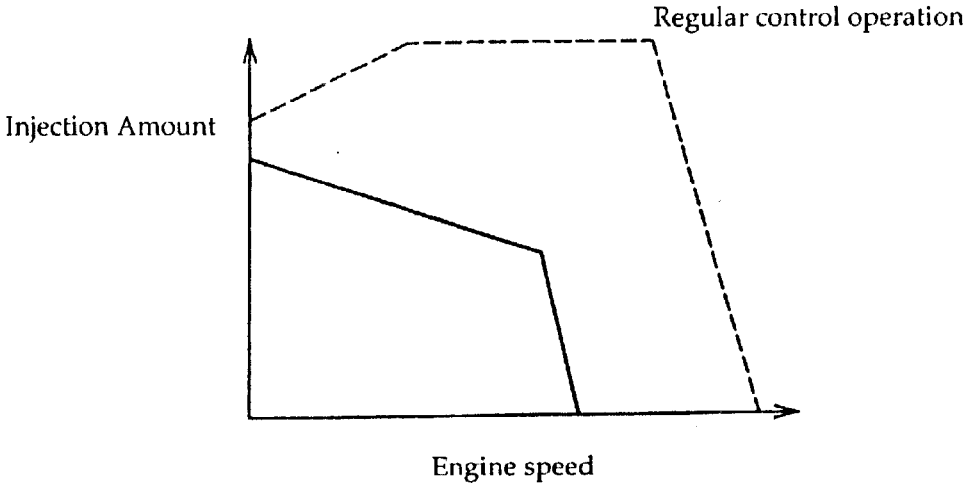
FIG. 22 is a characteristic diagram showing the relation between the engine speed and fuel injection rate.

In the failure time control mode (limp-home mode) of the pressure sensor 3*a* in Step S23 in FIG. 19, the electronic control unit 8 controls the switching of the control maps for controlling the fuel injection amount, injection pressure and the pressure control valve 34 for the low-pressure accumulator 4 to those for a failure mode. Namely, in the fuel injection amount control operation, a maximum injection amount and a maximum engine speed (maximum value) are restricted as shown by a solid line in FIG. 22 with respect to those (maximum values), which are shown by a broken line, in a regular mode. FIG. 22 is a characteristic diagram showing the relation between the engine speed and fuel injection amount.

Figure 23:
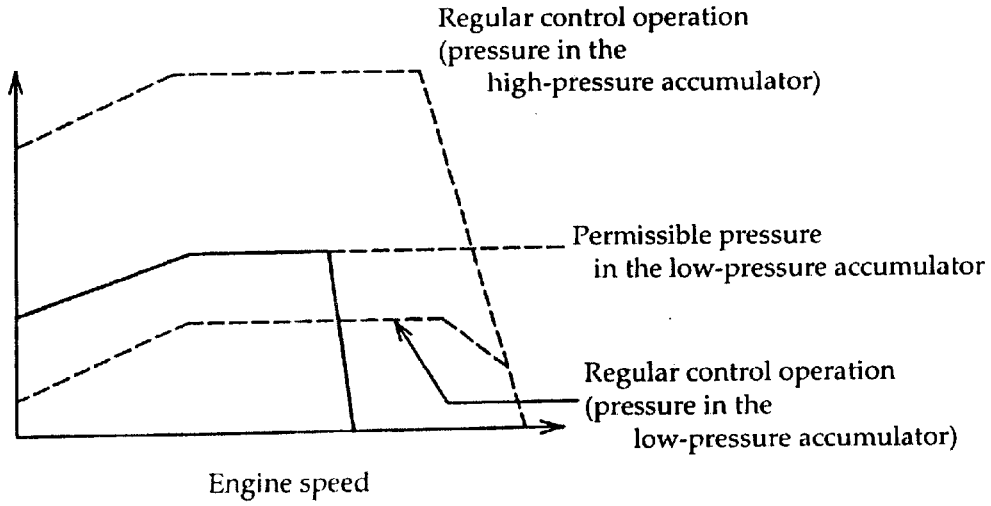
FIG. 23 is a characteristic diagram showing the relation between the engine speed and pressures (fuel pressures) in the high-pressure and low-pressure accumulators.

The electronic control unit 8 further controls a maximum pressure (fuel pressure) in the high-pressure accumulator 3 to be a predetermined level (which will hereinafter be referred to as "set pressure"). This set pressure controls the holding of the pressure control valve 34 in a fully-closed state, and the maximum pressure is controlled to be lower than the pressure (maximum pressure) in the high-pressure accumulator 3 in a regular control operation, in which the effective section of the force feed stroke of the plunger 21 (FIG. 1) of the high-pressure fuel pump 1 is regulated by using the detected value from the pressure sensor 4*a* for the low-pressure accumulator 4, and in which the maximum level of the discharge pressure is as shown by a broken line; higher than the pressure (maximum pressure) in the low-pressure accumulator 4 in a regular control operation; and not higher than the permissible withstanding pressure in the low-pressure accumulator 4. Consequently, the pressure in the high-pressure accumulator 3 becomes equal to that in the low-pressure accumulator 4. Since the maximum pressure (fuel pressure) in the high-pressure accumulator 3 is thus set not higher than the permissible withstanding pressure in the low-pressure accumulator 4, the occurrence of damage to the low-pressure accumulator 4 and the leakage of the fuel are prevented. FIG. 23 is a characteristic diagram showing the relation between the engine speed and the pressures (fuel pressures) in the high-pressure and low-pressure accumulators 3, 4.

Figure 18:
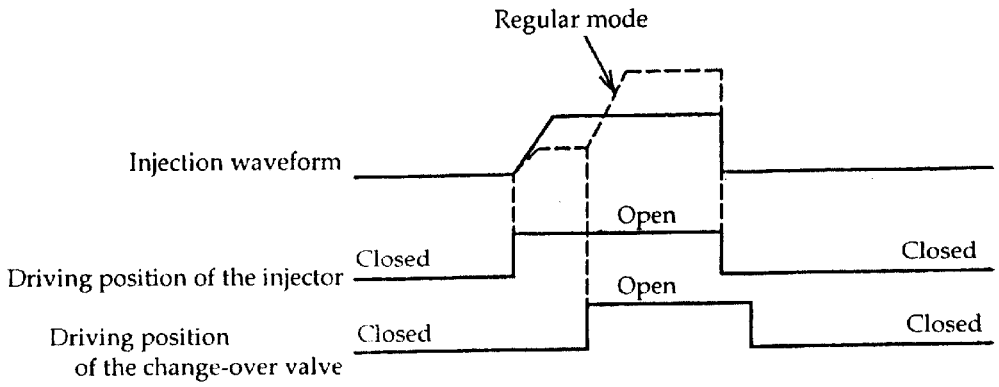
FIG. 18 is a timing chart showing a fuel injection waveform and the driving of the injectors and change-over valves in a failure mode of the pressure sensors of the high-pressure and low-pressure accumulators.

The controlling of the injector 9 and change-over valve 5 is simplified by using the same map as is used in a regular control operation. Since the pressure in the high-pressure accumulator 3 is at the same level as that in the low-pressure accumulator 4, the fuel is injected at the opening time of the injector 9, and a delay of the injection time with respect to a regular mode does not occur. Also, an increase in the inside-cylinder pressure is prevented. FIG. 18 is a timing chart showing the injection waveform and the driving of the injector 9 and change-over valve 5 in the failure mode for the pressure sensor 3*a*.

Even when the control mode is transferred to the failure time control mode (limp-home mode) in Step S23 after a judgement that the pressure sensor 4*a* breaks down was given in the judging operation in Step S22 in FIG. 19, the retention of the maximum pressure (fuel pressure) in the high-pressure accumulator 3 is controlled with the pressure control valve 34 in a fully-closed state, in such a manner that the maximum pressure is kept not higher than the permissible withstanding pressure of the low-pressure accumulator 4. Consequently, the pressure in the high-pressure accumulator 3 becomes equal to that in the low-pressure accumulator 4. Other control operations are carried out in a completely same manner as the aforementioned control operation carried out when the pressure sensor 3*a* gets out of order.

Thus, the failure of the pressure control valve 34 for controlling the pressure in the low-pressure accumulator 4 is judged by the electronic control unit 8, and, when the pressure control valve 34 gets out of order, the control mode is set to a limp-home mode, whereby damage to the engine body and, moreover, damage to the vehicle due to an overload operation of the engine body and an increase in the exhaust gas temperature can be avoided. When the pressure control valve 34, and the pressure sensor 3*a* for detecting the fuel pressure in the high-pressure accumulator 3 or the pressure sensor 4*a* for detecting the pressure in the low-pressure accumulator 4 get out of order, proper control operations are carried out in a limp-home mode, whereby the overload operation of the engine, the fluctuation of rotation thereof, and an increase in the inside-cylinder pressure, vibration noise and exhaust gas temperature are restrained to enable the vehicle to travel by itself to a repair shop.

What is claimed is:

1. An accumulator type fuel injection system having an accumulator adapted to store therein a fuel pressurized by a fuel pump, and a fuel injection valve to which the fuel stored in said accumulator is supplied, the fuel stored in said accumulator being injected from said injection valve into a combustion chamber, said fuel injection system comprising:

a first accumulator adapted to store therein a high-pressure fuel pressurized by said fuel pump, a plurality of fuel injection valves connected to said first accumulator via a plurality of fuel passages and having nozzles for injecting the fuel into said combustion chambers of said engine, a plurality of first control valves provided in said fuel passages and adapted to control the discharging of the high-pressure fuel in said first accumulator to a downstream side of said fuel passages, a second accumulator adapted to store therein a fuel the pressure of which is lower than that of the high-pressure fuel in said first accumulator and connected via branch passages to a plurality of portions of said fuel passages which are on a downstream side of said first control valves, a second control valve adapted to control the discharging of the low-pressure fuel in said second accumulator to an atmosphere-opened side, a failure detecting device that detects the occurrence of failure in said accumulator type fuel injection system, and a fuel control device adapted to control, during a regular operation of said engine, an operation for opening said first control valves in the midst of a period of time in which said fuel injection nozzles are opened and an operation for closing said first control valves simultaneously with the closure of said fuel injection nozzles, and set, when the occurrence of failure in said accumulator type fuel injection system is detected by said failure detecting device, a pressure of the fuel discharged from said fuel pump so that a fuel pressure in said fuel passages becomes not higher than a permissible pressure in said second accumulator.

2. An accumulator type fuel injection system according to claim 1, wherein:

said failure detecting device judges that at least one of said first control valves gets out of order.

3. An accumulator type fuel injection system according to claim 1, wherein:

said failure detecting device judges that said second control valve gets out of order in a closed state.

4. An accumulator type fuel injection system according to claim 1, wherein said fuel injection system is further provided with:

a fuel pressure detecting device for detecting a fuel pressure in said second accumulator, said fuel control device controlling the opening of said first control valves so as to discharge the high-pressure fuel in said first accumulator toward said second accumulator, and the opening of said second control valve in accordance with an output from said fuel pressure detecting device so as to have the fuel pressure in said second accumulator attain a set level, said failure detecting device judging that said second control valve gets out of order when a rate of opening thereof with respect to the set pressure is out of a reference region.

5. An accumulator type fuel injection system according to claim 1, wherein said fuel injection system is further provided with:

a first fuel pressure detecting device for detecting the fuel pressure in said first accumulator, and a second fuel pressure detecting device for detecting the fuel pressure in said second accumulator, said failure detecting device judging that said first fuel pressure detecting device gets out of order, said fuel control device closing said second control valve when the failure of said first fuel detecting device is detected by said failure detecting device, whereby a discharge pressure of said fuel pump is controlled in accordance with an output from said second fuel pressure detecting device so that the fuel pressure in said fuel passages becomes not higher than a permissible pressure in said second accumulator.

6. An accumulator type fuel injection system according to claim 5, wherein said failure detecting device judges that said first fuel pressure detecting device gets out of order when a ratio of an average value of absolute values of time variation rate of an output from said first fuel pressure detecting device to an average value of levels of an output therefrom is not higher than a predetermined level with a difference between a value of the level of an output from said first fuel pressure detecting device and that of a set pressure in said first accumulator not lower than a set level.

7. An accumulator type fuel injection system having an accumulator adapted to store therein a fuel pressurized by a fuel pump, and a fuel injection valve to which the fuel stored in said accumulator is supplied, the fuel stored in said accumulator being injected from said injection valve into a combustion chamber, said fuel injection system comprising:

a first accumulator means for storing therein a high-pressure fuel pressurized by said fuel pump, a plurality of fuel injection means for injecting the fuel into said combustion chambers of said engine, wherein the fuel injection means is connected to said first accumulator means via a plurality of fuel passages, a plurality of first control valve means provided in said fuel passages for controlling the discharging of the high-pressure fuel in said first accumulator means to a downstream side of said fuel passages, a second accumulator means for storing therein a fuel the pressure of which is lower than that of the high-pressure fuel in said first accumulator and connected via branch passages to a plurality of portions of said fuel passages which are on a downstream side of said first control valve means, a second control valve means for controlling the discharging of the low-pressure fuel in said second accumulator means to an atmosphere-opened side, a failure detecting means for detecting the occurrence of failure in said accumulator type fuel injection system, and a fuel control means for controlling, during a regular operation of said engine, an operation for opening said first control valve means in the midst of a period of time in which said fuel injection means are opened and an operation for closing said first control valve means simultaneously with the closure of said fuel injection means, and setting, when the occurrence of failure in said accumulator type fuel injection system is detected by said failure detecting means, a pressure of the fuel discharged from said fuel pump so that a fuel pressure in said fuel passages becomes not higher than a permissible pressure in said second accumulator means.

8. An accumulator type fuel injection system according to claim 7, wherein:

said failure detecting means judges that at least one of said first control valve means gets out of order.

9. An accumulator type fuel injection system according to claim 7, wherein:

said failure detecting means judges that said second control valve means gets out of order in a closed state.

10. An accumulator type fuel injection system according to claim 7, wherein said fuel injection system is further provided with:

a fuel pressure detecting means for detecting a fuel pressure in said second accumulator means, said fuel control means controlling the opening of said first control valve means so as to discharge the high-pressure fuel in said first accumulator means toward said second accumulator means, and the opening of said second control valve means in accordance with an output from said fuel pressure detecting means so as to have the fuel pressure means in said second accumulator means attain a set level, said failure detecting means judging that said second control valve means gets out of order when a rate of opening thereof with respect to the set pressure is out of a reference region.

11. An accumulator type fuel injection system according to claim 7, wherein said fuel injection system is further provided with:

a first fuel pressure detecting means for detecting the fuel pressure in said first accumulator means, and a second fuel pressure detecting means for detecting the fuel pressure in said second accumulator means, said failure detecting means judging that said first fuel pressure detecting means gets out of order, said fuel control means closing said second control valve means when the failure of said first fuel detecting means is detected by said failure detecting means, whereby a discharge pressure of said fuel pump is controlled in accordance with an output from said second fuel pressure detecting means so that the fuel pressure in said fuel passages becomes not higher than a permissible pressure in said second accumulator means.

12. An accumulator type fuel injection system according to claim 11, wherein said failure detecting means judges that said first fuel pressure detecting means gets out of order when a ratio of an average value of absolute values of time variation rate of an output from said first fuel pressure detecting means to an average value of levels of an output therefrom is not higher than a predetermined level with a difference between a value of the level of an output from said first fuel pressure detecting means and that of a set pressure in said first accumulator means not lower than a set level.

13. A fuel injection method having an accumulator adapted to store therein a fuel pressurized by a fuel pump, and a fuel injection valve means to which the fuel stored in said accumulator is supplied, the fuel stored in said accumulator being injected from said injection valve means into a combustion chamber, said fuel injection system comprising:

storing within a first accumulator means a high-pressure fuel pressurized by said fuel pump, injecting the fuel from the first accumulator means into said combustion chambers of said engine via a plurality of fuel passages, controlling the discharging of the high-pressure fuel with a plurality of first control valve means provided in said fuel passages in said first accumulator to a downstream side of said fuel passages, storing within a second accumulator means a fuel the pressure of which is lower than that of the high-pressure fuel in said first accumulator means and connected via branch passages to a plurality of portions of said fuel passages which are on a downstream side of said first control valve means, controlling the discharging of the low-pressure fuel in said second accumulator means to an atmosphere-opened side, detecting the occurrence of failure, and controlling, during a regular operation of said engine, an operation for opening said first control valve means in the midst of a period of time in which said fuel injection means are opened and an operation for closing said first control valve means simultaneously with the closure of said fuel injection means, and setting, when the occurrence of failure is detected by said failure detecting means, a pressure of the fuel discharged from said fuel pump so that a fuel pressure in said fuel passages becomes not higher than a permissible pressure in said second accumulator means.

14. A fuel injection method according to claim 13, wherein:

said failure detecting means judges that at least one of said first control valve means gets out of order.

15. A fuel injection method according to claim 13, wherein:

said failure detecting means judges that said second control valve means gets out of order in a closed state.

16. A fuel injection method according to claim 13, further comprising:

detecting a fuel pressure in said second accumulator means with a first fuel pressure detecting means, controlling with said fuel control means the opening of said first control valve means so as to discharge the high-pressure fuel in said first accumulator means toward said second accumulator means, and the opening of said second control valve means in accordance with an output from said fuel pressure detecting means so as to have the fuel pressure in said second accumulator means attain a set level, and judging with said failure detecting means that said second control valve means gets out of order when a rate of opening thereof with respect to the set pressure is out of a reference region.

17. A fuel injection method according to claim 13, further comprising:

detecting the fuel pressure in said first accumulator means with a first fuel pressure detecting means, and detecting the fuel pressure in said second accumulator means with a second fuel pressure detecting means, judging that said first fuel pressure detecting means gets out of order with said failure detecting means, closing said second control valve means with said fuel control means when the failure of said first fuel detecting means is detected by said failure detecting means, whereby a discharge pressure of said fuel pump is controlled in accordance with an output from said second fuel pressure detecting means so that the fuel pressure in said fuel passages becomes not higher than a permissible pressure in said second accumulator means.

18. A fuel injection method according to claim 17, wherein said failure detecting means judges that said first fuel pressure detecting means gets out of order when a ratio of an average value of absolute values of time variation rate of an output from said first fuel pressure detecting means to an average value of levels of an output therefrom is not higher than a predetermined level with a difference between a value of the level of an output from said first fuel pressure detecting means and that of a set pressure in said first accumulator means not lower than a set level.

* * * * *